US010390677B2

(12) United States Patent
Woo et al.

(10) Patent No.: US 10,390,677 B2
(45) Date of Patent: Aug. 27, 2019

(54) DISH WASHER WITH ECCENTRIC PROTRUSION IN POWER TRANSFER ASSEMBLY

(71) Applicant: LG Electronics Inc., Seoul (KR)

(72) Inventors: Seyoung Woo, Seoul (KR); Joonho Pyo, Seoul (KR); Daegyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 246 days.

(21) Appl. No.: 15/615,291

(22) Filed: Jun. 6, 2017

(65) Prior Publication Data

US 2017/0265709 A1 Sep. 21, 2017

Related U.S. Application Data

(62) Division of application No. 15/013,049, filed on Feb. 2, 2016.

(30) Foreign Application Priority Data

Feb. 2, 2015 (KR) ..... 10-2015-0016157
Feb. 2, 2015 (KR) ..... 10-2015-0016158
Apr. 15, 2015 (KR) ..... 10-2015-0053149

(51) Int. Cl.
*A47L 15/23* (2006.01)
*A47L 15/22* (2006.01)
*A47L 15/42* (2006.01)

(52) U.S. Cl.
CPC ..... *A47L 15/23* (2013.01); *A47L 15/22* (2013.01); *A47L 15/4282* (2013.01)

(58) Field of Classification Search
None
See application file for complete search history.

(56) References Cited

U.S. PATENT DOCUMENTS 5,464,482 A 11/1995 Michael et al.
8,210,191 B2 7/2012 Gnadinger et al.
(Continued)

FOREIGN PATENT DOCUMENTS

CN 103356143 A 10/2013
CN 105266736 1/2016
(Continued)

OTHER PUBLICATIONS

Chinese Office Action in Chinese Application No. 20160065270.X, dated Feb. 23, 2018, 23 pages.
(Continued)

*Primary Examiner* — Rita P Adhlakha
(74) *Attorney, Agent, or Firm* — Fish & Richardson P.C.

(57) ABSTRACT

A dishwasher may include a tub configured to accommodate one or more items to be washed, a spray arm rotatably mounted to the tub, and configured to spray water onto the one or more items to be washed, a sump disposed at a bottom surface of the tub and configured to store water and to supply stored water to the spray arm, a fixed gear unit fixed to the tub with gear teeth arranged along an outer circumferential surface of the fixed gear unit, a rotary gear unit rotatably mounted on the spray arm and configured to engage the gear teeth of the fixed gear unit, and a link member connected to the rotary gear unit and the spray arm, where the spray arm may include, a main arm with a pair of arms, and a pair of auxiliary arms rotatably connected to the main arm.

14 Claims, 33 Drawing Sheets

(56) References Cited

U.S. PATENT DOCUMENTS

| | | | |
|---|---|---|---|
| 8,578,954 | B2 | 11/2013 | Rappette et al. |
| 2011/0146734 | A1 | 6/2011 | Rappette et al. |
| 2012/0279536 | A1 | 11/2012 | Adams et al. |
| 2013/0091908 | A1 | 4/2013 | Lee |
| 2013/0276841 | A1 | 10/2013 | Han |
| 2015/0230687 | A1 | 8/2015 | Dries et al. |

FOREIGN PATENT DOCUMENTS

| | | |
|---|---|---|
| CN | 105266739 | 1/2016 |
| DE | 102010038184 | 6/2011 |
| EP | 1040787 | 10/2000 |
| EP | 2522268 | 11/2012 |
| JP | 08089467 | 4/1996 |
| JP | 2782943 | 8/1998 |
| JP | 3437241 | 6/2003 |
| JP | 2015-009011 | 1/2015 |
| KR | 10-2012-0078276 | 7/2012 |
| KR | 10-2012-0134370 | 12/2012 |
| KR | 10-2013-0110867 | 10/2013 |
| KR | 10-2013-0119086 | 10/2013 |
| KR | 10-2014-0039747 | 4/2014 |

OTHER PUBLICATIONS

Office Action in U.S. Appl. No. 15/013,049, dated Jul. 26, 2018, 23 pages.

Office Action in Chinese Patent Application No. 201710152474.1, dated Aug. 29, 2018, 9 pages (with English Translation).

Extended European Search Report in European Application No. 1605080.1, dated Mar. 6, 2017, 7 pages (with English translation).

Extended European Search Report in European Application No. 16205085.0, dated Mar. 6, 2017, 6 pages (with English translation).

Extended European Search Report in European Application No. 16205082.7, dated Feb. 24, 2017, 7 pages (with English translation).

S

DISH WASHER WITH ECCENTRIC PROTRUSION IN POWER TRANSFER ASSEMBLY

CROSS-REFERENCE TO RELATED APPLICATION(S)

This application is a divisional of U.S. application Ser. No. 15/013,049, filed Feb. 2, 2016, now pending, which claims priority under 35 U.S.C. 119 and 35 U.S.C. 365 to Korean Patent Application No. 10-2015-0016157 (filed on Feb. 2, 2015), No. 10-2015-0016158 (filed on Feb. 2, 2015) and No. 10-2015-0053149 (filed on Apr. 15, 2015), which are hereby incorporated by references in their entirety.

BACKGROUND

A dishwasher is a household appliance which uses detergent and water to wash food scraps off dirty dishes and cooking utensils.

Generally, a dishwasher includes a tub, a dish rack disposed in the tub to accommodate objects to be washed, a spray arm to spray wash water to the dish rack, a sump to store the wash water, and a supply flow passage to supply the wash water stored in the sump to the spray arm.

An idea related to the dishwasher is disclosed in Korean Patent Application Publication No. 10-2012-0126598, which is a related art document.

The dishwasher disclosed in the related art document has a structure for spraying wash water upward by a nozzle of a spray arm accommodated in a tub.

SUMMARY

According to one aspect, a dishwasher may include a tub configured to accommodate one or more items to be washed, a spray arm rotatably mounted to the tub and configured to spray water onto the one or more items to be washed, a sump disposed at a bottom surface of the tub and configured to store water and to supply stored water to the spray arm, a fixed gear unit fixed to the tub with gear teeth arranged along an outer circumferential surface of the fixed gear unit, a rotary gear unit rotatably mounted on the spray arm and configured to engage the gear teeth of the fixed gear unit, and a link member connected to the rotary gear unit and the spray arm, where the spray arm may include a main arm including a pair of arms, and a pair of auxiliary arms rotatably connected to the main arm, where the rotary gear unit may be configured to rotate based on engagement with the gear teeth of the fixed gear unit by rotation of the main arm, and where the link member may be configured to move by rotation of the rotary gear unit and rotate the pair of auxiliary arms.

Implementations according to this aspect may include one or more of the following features. For example, the dishwasher may include one or more power transfer units configured to extend from bottom surfaces of the pair of auxiliary arms and configured to be inserted into the link member, where one or more locking parts may be located at the link member, and where one or more power transfer units may be configured to be inserted into the one or more locking parts to transfer power to the power transfer units. The dishwasher may include a protrusion provided at an eccentric position from a center of rotation of the rotary gear unit and configured to be inserted into the link member, where the link member may include an insertion part, and where the protrusion may be configured to be inserted into the insertion part. The protrusion may be configured to move in a circular motion by the rotation of the rotary gear unit to move the link member. The dishwasher may include a guide protrusion inserted into the link member and configured to guide the link member to move back and forth in a linear motion, where a guide unit, into which the guide protrusion is inserted, may be located at a main extension part. The link member may include a main extension part disposed at lower portions of the pair of arms disposed at the main arm and one or more auxiliary extension parts disposed at lower portions of the pair of auxiliary arms. Each of the one or more auxiliary extension parts may be elastically deformed in a direction of a movement of the link member. The one or more auxiliary extension parts may be configured to be bent several times. One or more stoppers may be disposed at the auxiliary extension parts, and may be configured to limit rotational ranges of the pair of auxiliary arms. The gear teeth disposed at the fixed gear unit and the rotary gear unit may have asymmetrical shapes and may include a vertical portion and an inclined portion which extends from an upper end of the vertical portion at a predetermined angle. The spray arm may be configured to rotate by a repulsive force generated based on water being sprayed through spray holes in the main arm or each of the pair of the auxiliary arms.

According to another aspect, a dishwasher may include a sump configured to store water, an arm holder rotatably mounted on the sump, a spray arm connected to the arm holder and configured to spray the stored water from the sump, a fixed gear unit fixed to the sump and with gear teeth arranged along an outer circumferential surface of the fixed gear unit, a rotary gear unit rotatably mounted on the spray arm, and configured to rotate based on engagement with the gear teeth of the fixed gear unit, and a link member connected to the rotary gear unit and the spray arm, where the spray arm includes a main arm with a lower frame connected to the arm holder and an upper frame disposed at an upper side of the lower frame, and a pair of auxiliary arms rotatably disposed at both sides of the main arm and having a plurality of auxiliary spray holes, where inlets through which the water is introduced are formed at the lower frame, wherein a main flow passage is formed in the main arm and may be in fluid communication with the inlets, where a plurality of upper spray holes may be formed in the upper frame, and where the plurality of spray holes may be configured to spray the water in the main flow passage, where the plurality of upper spray holes may be radially disposed in the upper frame.

Implementations according to this aspect may include one or more of the following features. For example, the plurality of upper spray holes may be biased to one side of the main arm, and where the spray arm may be configured to rotate in one direction by a repulsive force generated when the water is sprayed through the main spray holes and the plurality of auxiliary spray holes may be biased to the other side of the main arm, and where the spray arm may be configured to rotate in an opposite direction by the repulsive force generated when the water is sprayed. A subset of the plurality of upper spray may be parallel to a direction in which the water is sprayed. A subset of the plurality of auxiliary spray holes may be parallel to the direction in which the water is sprayed. The dishwasher may include lower spray holes formed in a bottom surface of the lower frame, and configured to spray the water flowing in the main flow passage. A transfer flow passage may be formed in the main arm and may be in fluid communication with the inlets, where auxiliary flow passages may be formed in the auxiliary arms and may be in fluid communication with the transfer flow passage, and where the auxiliary flow passages may be in fluid communication with the auxiliary spray holes. The dishwasher may include a flow passage switching unit accommodated in the arm holder, and configured to selectively open and close the main flow passage and the transfer flow passage.

The flow passage switching unit may include a switching unit main body, an upper gear formed at the switching unit main body, and opening holes through which the water flows, where an upper gear engaging unit may be disposed at the bottom surface of the main arm, and may be configured to engage with the upper gear, where the flow passage switching unit may be configured to be engaged with the upper gear engaging unit when a flow amount of the water introduced into an arm holder chamber is increased, where one of the main flow passage and the transfer flow passage may be configured to communicate with the opening holes to have the water introduced and the other one of the main flow passage and the transfer flow passage may be closed by the switching unit main body when the upper gear is engaged with the upper gear engaging unit. A lower gear protruding downward may be disposed at the flow passage switching unit, and where a lower gear engaging unit may be disposed at a bottom surface of the arm holder chamber, and may be configured to be engaged with the lower gear. A rotary unit configured to provide a rotary force to the flow passage switching unit may be disposed at a bottom surface of the flow passage switching unit. The main arm may include a gear rotation shaft onto which the rotary gear unit is inserted, where the rotary gear unit may be configured to move vertically based on insertion into the gear rotation shaft so that the gear teeth of the fixed gear unit and the gear teeth of the rotary gear unit are selectively engaged with each other. The dishwasher may include an elastic unit disposed at the rotary gear unit, and configured to press the rotary gear unit toward the fixed gear unit. The gear teeth of the rotary gear unit may be configured to come in close contact with the gear teeth of the fixed gear unit by the hydraulic pressure of the water when the water is sprayed through the spray holes. The dishwasher may include a mounting unit at which the gear rotation shaft may be disposed and with a bottom surface portion configured to selectively make contact with an upper surface portion of the rotary gear unit, where the bottom surface portion of the mounting unit may be formed in a shape gradually inclined more upward from the gear rotation shaft toward the fixed gear unit. The spray holes may be disposed in the gear rotation shaft so that the wash water sprayed through the spray holes heads toward an inside of the rotary gear unit. The gear rotation shaft may be disposed at a place where a portion of a bottom surface of the main arm is recessed by a predetermined depth, where the gear rotation shaft may be inserted into the rotary gear unit and a rotation shaft accommodation unit may be disposed at the rotary gear unit, where at least a portion of the rotation shaft accommodation unit may be accommodated in the recessed place.

According to yet another aspect, a dishwasher may include a sump configured to store water, an arm holder rotatably mounted on the sump, a spray arm connected to the arm holder, and configured to rotate by a repulsive force generated when the stored water introduced from the sump is sprayed, a fixed gear unit fixed to the sump and with gear teeth arranged along an outer circumferential surface of the fixed gear unit, a rotary gear unit rotatably mounted on the spray arm, and configured to rotate based on engagement with the gear teeth of the fixed gear unit by rotation of the spray arm, and a link member connected to the rotary gear unit and the spray arm, where the spray arm includes a main arm including an arm holder coupling unit connected to the arm holder, a first arm extending to one side of the arm holder coupling unit, and a second arm extending to the other side of the arm holder coupling unit, and a first auxiliary arm and a second auxiliary arm disposed at the main arm in opposite directions from each other, and each of the first auxiliary arm and the second auxiliary arm is configured to rotate with respect to a longitudinal direction.

Implementations according to this aspect may include one or more of the following features. For example, the first auxiliary arm may be configured to form an acute angle with the first arm, and the second auxiliary arm may be configured to form an acute angle with the second arm. The link member may be configured to move back and forth by the rotary gear unit when the spray arm rotates, and the back and forth movements of the link member may be converted to rotary movements of the auxiliary arms. A plurality of auxiliary spray holes may be formed in the first auxiliary arm and the second auxiliary arm, where at least one of the plurality of auxiliary spray holes formed in the first auxiliary arm and at least one of the plurality of auxiliary spray holes formed in the second auxiliary arm are parallel to a direction in which the water is sprayed.

DETAILED DESCRIPTION

Figure 1:
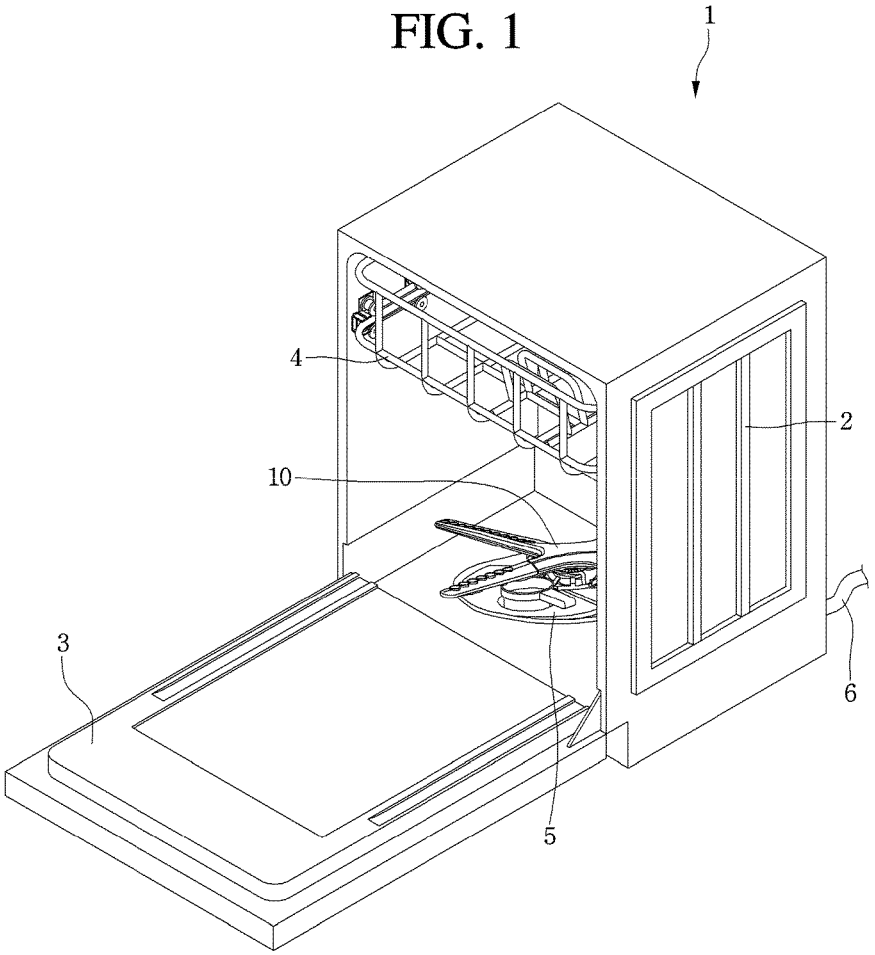
FIG. 1 is a perspective view of an example of a dishwasher implementation.
Figure 2:
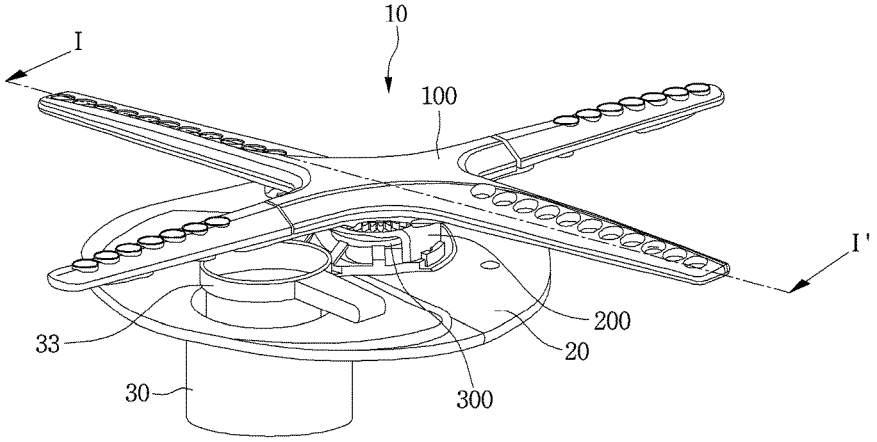
FIG. 2 is a view illustrating an example of a coupling structure between a sump of FIG. 1 and a spray arm assembly.

Referring to FIGS. 1 and 2, a dishwasher 1 may include a tub 2 in which a washing space is formed, a door 3 which may be configured to selectively open and close the washing space, a rack 4 disposed in the tub 2 to accommodate an object to be washed, a sump 5 disposed in the tub 2 to store wash water, and a spray arm assembly 10 disposed in the tub 2 to spray the wash water onto the object to be washed accommodated in the rack 4.

The rack 4 may be mounted to be withdrawn to the front of the tub 2. A user may withdraw the rack 4 to the front of the tub 2 to accommodate the object to be washed.

The sump 5 may include a sump cover 20 and a sump discharge unit 30 disposed at the sump cover 20. The sump 5 may receive the wash water from the outside through a water supply unit 6, and may discharge the wash water sprayed in the tub 2 through the sump discharge unit 30. A water supply pump to transfer the wash water stored in the sump 5 to the spray arm assembly 10 may be disposed in the sump 5.

A wash water recovery unit 33 to recover the wash water sprayed in the tub 2 may be disposed at the sump discharge unit 30. Foreign substances such as food scraps contained in the wash water may be filtered by a filter disposed in the wash water recovery unit 33. The wash water recovered in the sump 5 through the wash water recovery unit 33 may be resupplied to the spray arm assembly 10 by the water supply pump disposed in the sump 5. The wash water supplied through the water supply unit 6 may be reused several times.

The spray arm assembly 10 may be mounted on the sump cover 20 to spray the wash water stored in the sump 5 onto the object to be washed accommodated in the rack. The spray arm assembly 10 may include a spray arm 100 to spray the wash water, a fixed gear unit 200 mounted on the sump cover 20 to rotatably support the spray arm 100, and an arm holder 300.

The wash water introduced through the water supply unit 6 may flow through the sump 5 to be introduced into the spray arm assembly 10, and the wash water introduced into the spray arm assembly 10 may be sprayed by the spray arm 100 onto the object to be washed. The spray arm assembly 10 may be directly connected to the water supply unit 6 and directly spray the wash water onto the object to be washed without passing through the sump 5.

The spray arm assembly 10 may not only be disposed below the rack 4 as illustrated, but also be disposed above the rack 4. Also, the spray arm assembly 10 may be disposed in a plurality to spray the wash water from above and below the rack 4.

Figure 3:
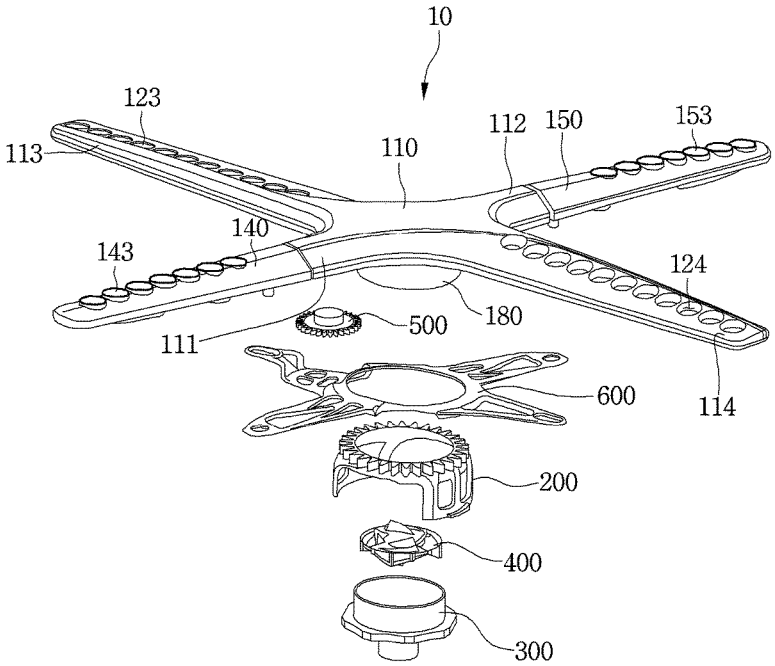
FIG. 3 is an exploded perspective view of an example of the spray arm assembly of FIG. 2.

As illustrated in FIG. 3, the spray arm assembly 10 may include the spray arm 100, the fixed gear unit 200, the arm holder 300, a flow passage switching unit 400, a rotary gear unit 500, and a link member 600.

The spray arm 100 may include a main arm 110 and auxiliary arms 140 and 150 which may be rotatably connected to the main arm 110. The auxiliary arms 140 and 150 may be provided as one pair as illustrated. A plurality of flow passages through which the wash water provided from the sump 5 flows may be formed in the main arm 110.

Upper spray holes 123 and 124 through which the wash water introduced into the main arm 110 is sprayed, may be formed in an upper portion of the main arm 110. The wash water introduced into the main arm 110 from the sump 5 may be sprayed above the main arm 110 through the upper spray holes 123 and 124. The wash water sprayed through the upper spray holes 123 and 124 may head toward the object to be washed.

The main arm 110 may include an arm holder coupling unit 180 disposed at a bottom surface of the main arm 110 and may include at least a portion of the arm holder 300.

The auxiliary arms 140 and 150 may be rotated by the link member 600 within a predetermined angle range. Upper auxiliary spray holes 143 and 153 may be configured to spray the wash water introduced into the main arm 110. Upper auxiliary spray holes 143 and 153 may also be formed in the auxiliary arms 140 and 150.

The main arm 110 may include a first extension part 111 and a second extension part 112 radially extending with respect to the arm holder coupling unit 180. The auxiliary arms 140 and 150 may be respectively and rotatably mounted on the first extension part 111 and the second extension part 112.

A first transfer flow passage and a second transfer flow passage through which the wash water introduced from the sump 5 flows may be respectively formed in the first extension part 111 and the second extension part 112. The wash water flowing through the first transfer flow passage and the second transfer flow passage may flow to the auxiliary arms 140 and 150.

The auxiliary arms 140 and 150 may include a first auxiliary arm 140 rotatably connected to the first extension part 111, and a second auxiliary arm 150 rotatably connected to the second extension part 112. Some of the wash water introduced into the main arm 110 may flow to a first auxiliary flow passage formed in the first auxiliary arm 140, and a second auxiliary flow passage formed in the second auxiliary arm 150.

A first upper auxiliary spray hole 143 may be formed in the first auxiliary arm 140, and a second upper auxiliary spray hole 153 may be formed in the second auxiliary arm 150. The wash water introduced into the first auxiliary flow passage formed in the first auxiliary arm 140 may be sprayed through the first upper auxiliary spray hole 143, and the wash water introduced into the second auxiliary flow passage formed in an inner space of the second auxiliary arm 150 may be sprayed through the second upper auxiliary spray hole 153.

The spray arm 100 may be rotated by a separate driving device. However, the spray arm 100 may be rotated by a repulsive force generated when the wash water is sprayed through upper spray holes 123 and 124 or the upper auxiliary spray holes 143 and 153. The spray arm 100 may be rotated by the repulsive force generated by spraying the wash water without a separate driving device such as a motor.

The rotation of the spray arm 100 by the spraying of the wash water will be described below. The main arm 110 may include a first arm 113 extending along one direction from a center of the main arm 110, and a second arm 114 extending along the opposite direction of the first arm 113. A first upper spray hole 123 may be formed in the first arm 113, and a second upper spray hole 124 may be formed in the second arm 114.

The first upper spray hole 123 may be formed in a plurality along a longitudinal direction of the first arm 113. The second upper spray hole 124 may be formed in a plurality along a longitudinal direction of the second arm 114.

The wash water introduced into the spray arm 100 may flow to the main arm 110, and be sprayed through the upper spray holes 123 and 124. The wash water introduced into the spray arm 100 may flow to the auxiliary arms 140 and 150, and be sprayed through the upper auxiliary spray holes 143 and 153.

The fixed gear unit 200 may be fixed to the sump cover 20 by a gear fixing unit 22 disposed at the sump cover 20. The fixed gear unit 200 is disposed to be engaged with the rotary gear unit 500.

The arm holder 300 may be coupled to the spray arm 100 and be fixed to the spray arm 100. Accordingly, the arm holder 300 may rotate together with the spray arm 100, and may serve as a central axis of rotation of the spray arm 100.

The arm holder 300 may be rotatably fixed to the sump cover 20 while being coupled to the spray arm 100. The wash water supplied from the sump 5 is supplied to the spray arm 100 after being introduced into the arm holder 300.

The arm holder 300 may be integrally formed with the main arm 110. In some examples, the main arm 110 may be rotatably fixed to the sump cover 20.

The flow passage switching unit 400 may be accommodated in the arm holder 300, and serve to switch the flow passage of the wash water supplied to the spray arm 100 from the arm holder 300. A detailed function of the flow passage switching unit 400 is described below.

The rotary gear unit 500 may be rotatably mounted on a bottom surface of the spray arm 100. When the spray arm 100 rotates, the rotary gear unit 500 may simultaneously move in a circular direction along a circumference of the fixed gear unit 200 fixed to the sump cover 20, and rotate by being engaged with the fixed gear unit 200.

Figure 4:
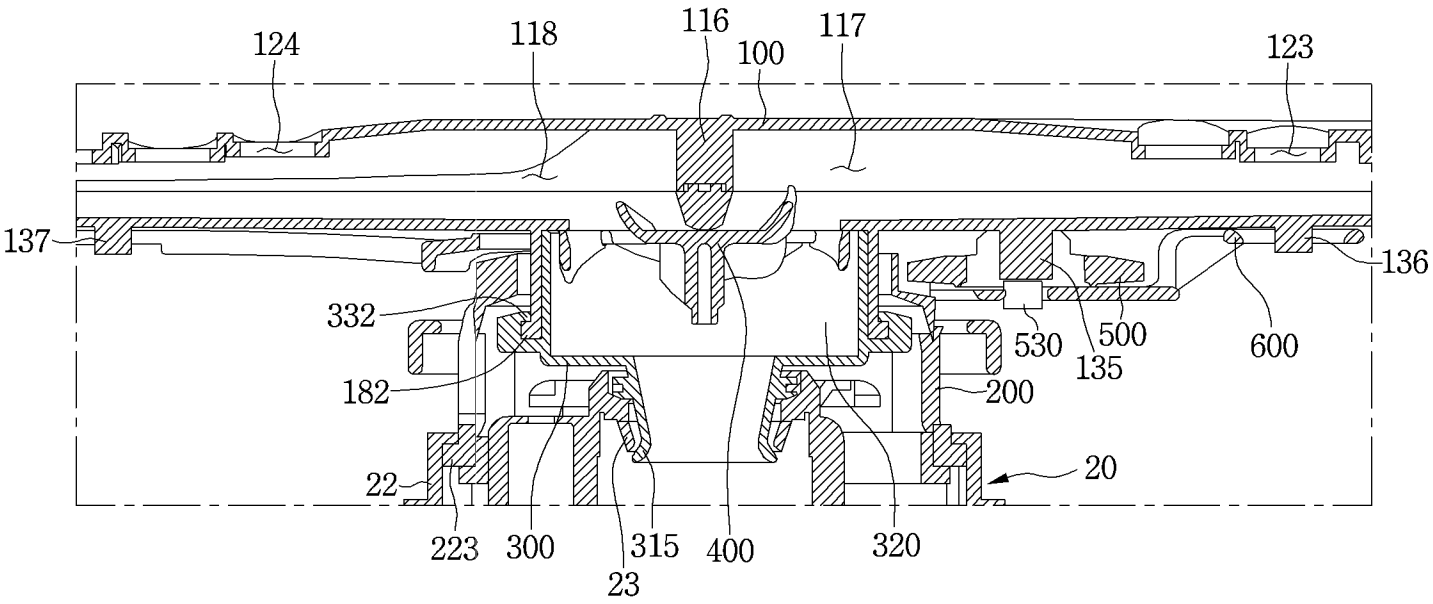
FIG. 4 is a cross-sectional view of an example of the spray arm assembly of FIG. 2 taken along line I-I'.

The link member 600 may be mounted on the spray arm 100. The link member 600 may reciprocally rotate the auxiliary arms 140 and 150 about the longitudinal direction as the rotary gear unit 500 rotates. Referring to FIG. 4, the spray arm assembly 10 may be fastened to the sump cover 20. The arm holder 300 may be rotatably fixed to the sump cover 20 as a departure prevention part 315 disposed at the arm holder 300 may be fastened to an arm holder fastening part 23 disposed at the sump cover 20.

A fastening part 223 disposed at the fixed gear unit 200 may be fastened to the gear fixing unit 22 disposed at the sump cover 20. The fixed gear unit 200 may be coupled to the sump cover 20. Unlike the arm holder 300, the fixed gear unit 200 is non-rotatably fixed.

The rotary gear unit 500 may be inserted into a gear rotation shaft 135 disposed at the spray arm 100. The rotary gear unit 500 may be coupled to the spray arm 100, and may rotate about the gear rotation shaft 135.

The link member 600 may be supported by guide protrusions 136 and 137 disposed at the spray arm 100. An eccentric protrusion 530 disposed at the rotary gear unit 500 may be inserted into the link member 600. By the rotation of the fixed gear unit 200, the eccentric protrusion 530 may be configured to rotate the link member 600 back and forth within a predetermined range.

A fastening protrusion 182 disposed at the spray arm 100 may be inserted into a fastening protrusion accommodation unit 332 disposed at the arm holder 300. The arm holder 300 is coupled to the spray arm 100.

Main flow passages 117 and 118 through which the wash water introduced from the arm holder 300 flows may be formed in the spray arm 100. Specifically, the main flow passages 117 and 118 may include a first main flow passage 117 formed in the first arm 113, and a second main flow passage 118 formed in the second arm 114. The first main flow passage 117 and the second main flow passage 118 may be divided from each other by a partition 116. The wash water flowing through the first main flow passage 117 may be sprayed to the outside through the first upper spray hole 123, and the wash water flowing through the second main flow passage 118 may be sprayed to the outside through the second upper spray hole 124. The main flow passages 117 and 118 may be referred to as 'wash water flow passages.'

The flow passage switching unit 400 may be accommodated in an arm holder chamber 320 disposed in the arm holder 300. The flow passage switching unit 400 may move upward when the hydraulic pressure in the arm holder chamber 320 increases due to the wash water being introduced into the arm holder chamber 320, and the flow passage switching unit 400 may move downward when the hydraulic pressure in the arm holder chamber 320 decreases due to the introduction of the wash water into the arm holder chamber 320 being stopped.

In addition, the wash water accommodated in the arm holder chamber 320 may be introduced into the main arm 110.

Figure 5:
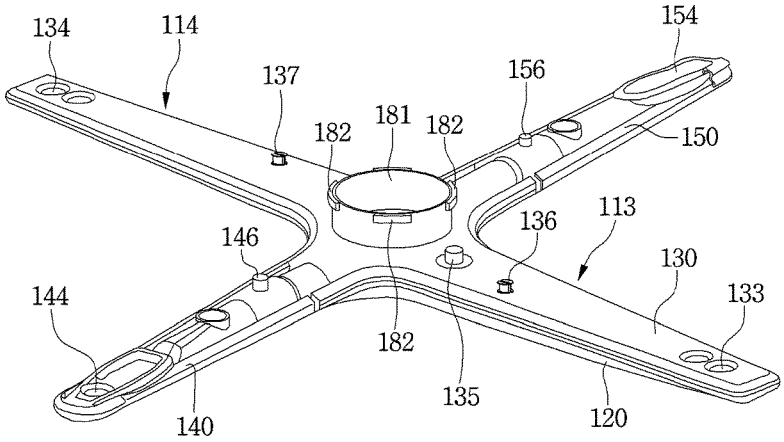
FIG. 5 is a view illustrating an example of a bottom surface of the spray arm of FIG. 3.
Figure 6:
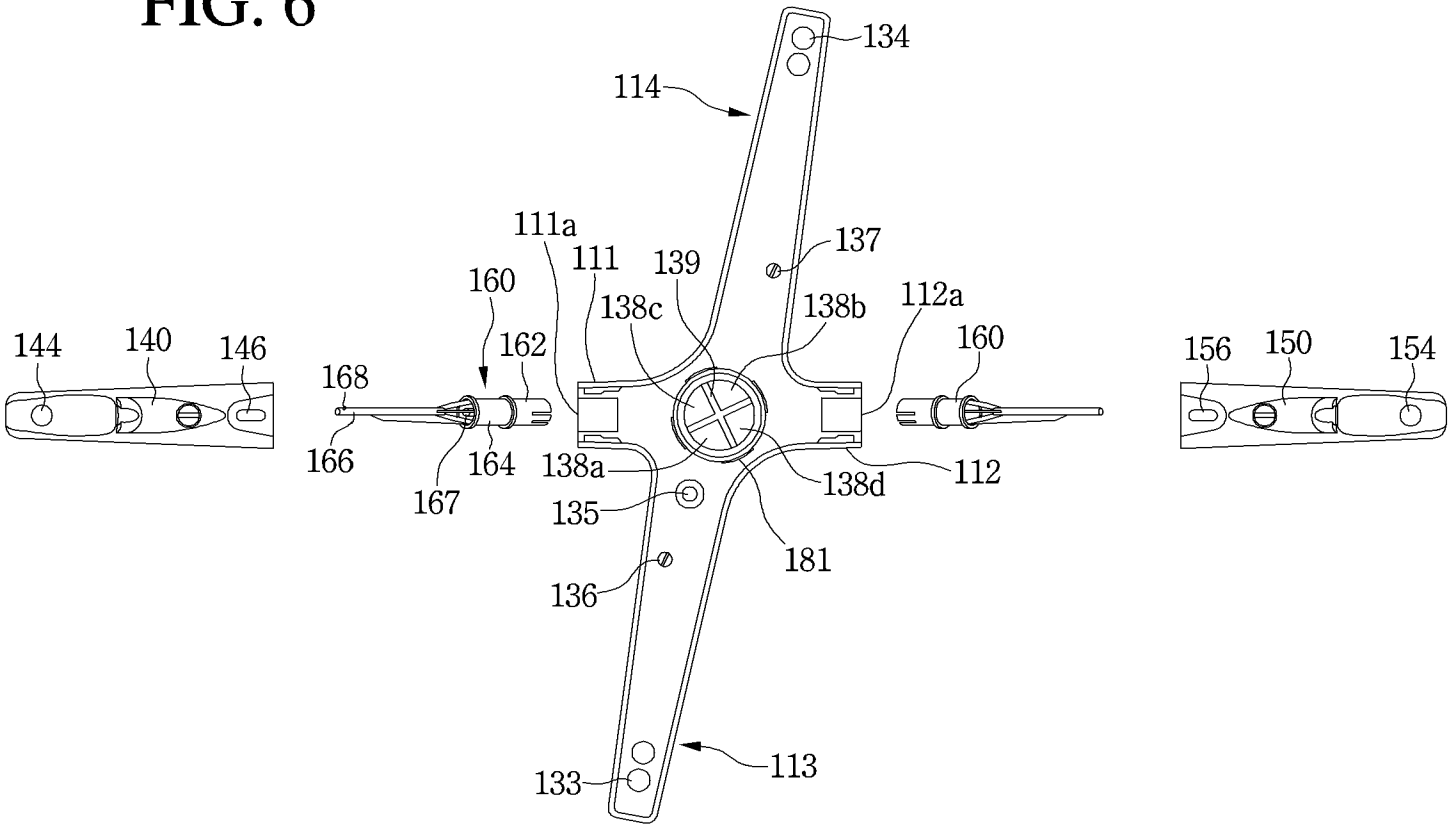
FIG. 6 is an exploded view of an example of the spray arm of FIG. 5.

Referring to FIGS. 5 and 6, the spray arm 100 may include the main arm 110, the auxiliary arms 140 and 150, and auxiliary arm connection members 160 to connect the main arm 110 to the auxiliary arms 140 and 150. The main arm 110 may include an upper frame 120 and a lower frame 130.

Lower spray holes 133 and 134 through which the wash water introduced into the main arm 110 is sprayed may be formed in the lower frame 130. The wash water introduced into the main arm 110 may be sprayed below the main arm 110 through the lower spray holes 133 and 134. The upper spray holes 123 and 124 and the lower spray holes 133 and 134 may be collectively referred to as 'main spray holes.'

A repulsive force may be generated below the main arm 110 when the wash water is sprayed upward from the upper spray holes 123 and 124, and the repulsive force may be generated above the main arm 110 when the wash water is sprayed downward from the lower spray holes 133 and 134. Thus, since the repulsive force acts above or below the main arm 110 when the wash water is sprayed through only one among the upper or lower spray holes, coupling of the spray arm assembly 10 may be difficult. The wash water introduced into the main arm 110 may be simultaneously sprayed through the upper spray holes 123 and 124 and the lower spray holes 133 and 134, thereby offsetting the repulsive forces in the upper and lower directions acting on the main arm 110 due to the spraying of the wash water.

The main arm 110 may include a first outlet 111*a* formed at the first extension part 111, and a second outlet 112*b* formed at the second extension part 112. A portion of the wash water introduced into the main arm 110 through the sump 5 may be introduced into the first auxiliary arm 140 through the first outlet 111*a*, and a portion may be introduced into the second auxiliary arm 150 through the second outlet 112*b*.

As illustrated, the first auxiliary arm 140 may be disposed to form an acute angle with the first arm 113, and the second auxiliary arm 150 may be disposed to form an acute angle with the second arm 114. However, implementations are not limited to this shape, and the shape may be appropriately changed according to a design. For example, the first arm 113 and the second arm 114 may be disposed to form an acute angle, and the first auxiliary arm 140 an the second auxiliary arm 150 may be disposed to form an acute angle.

Lower auxiliary spray holes 144 and 154 may be formed in bottom surfaces of the auxiliary arms 140 and 150. A first lower auxiliary spray hole 144 may be formed in the first auxiliary arm 140, and a second lower auxiliary spray hole 154 may be formed in the second auxiliary arm 150.

The wash water introduced into the auxiliary arms 140 and 150 may be simultaneously sprayed through the upper auxiliary spray holes 143 and 153 and the lower auxiliary spray holes 144 and 154, thereby offsetting the repulsive forces in the upper and lower directions acting on the auxiliary arms 140 and 150 due to the spraying of the wash water.

The upper auxiliary spray holes 143 and 153 and the lower auxiliary spray holes 144 and 154 may be collectively referred to as 'auxiliary spray holes.'

The main arm 110 may include the gear rotation shaft 135 inserted into the rotary gear unit 500 to serve as a rotation shaft of the rotary gear unit 500. The gear rotation shaft 135 may protrude from the lower frame 130. The gear rotation shaft 135 may be disposed at the bottom surface of the first arm 113 as illustrated, but the implementations are not limited thereto.

The spray arm 100 may include the guide protrusions 136 and 137 to guide a movement of the link member 600. The guide protrusions 136 and 137 may include a first guide protrusion 136 disposed at the bottom surface of the first arm 113, and a second guide protrusion 137 disposed at the bottom surface of the second arm 114. The first guide protrusion 136, the gear rotation shaft 135, and the second guide protrusion 137 may be placed on one straight line.

The auxiliary arms 140 and 150 may include power transfer units 146 and 156 to receive power from the link member 600. The power transfer units 146 and 156 may be formed of protrusions that protrude downward from the bottom surfaces of the auxiliary arms 140 and 150. A first power transfer unit 146 may be disposed at the first auxiliary arm 140, and a second power transfer unit 156 may be disposed at the second auxiliary arm 150.

The link member 600 may be configured to transfer the power received from the rotary gear unit 500 to the power transfer units 146 and 156, thereby enabling the auxiliary arms 140 and 150 to rotate back and forth. The reciprocating movement of the link member 600 may be converted to the rotary movement of the auxiliary arms 140 and 150.

The main arm 110 may include the arm holder coupling unit 180 disposed at the lower frame 130. The arm holder coupling unit 180 may include an arm holder accommodation tube 181 into which the arm holder 300 is inserted, and the fastening protrusion 182 fastened to the arm holder 300. The fastening protrusion 182 is fastened to the arm holder 300, thereby enabling the main arm 110 to be fixed to the arm holder 300.

The arm holder accommodation tube 181 may extend downward from the lower frame 130. The arm holder accommodation tube 181 may be formed in a cylindrical shape, and may come in contact with the arm holder 300.

The fastening protrusion 182 may be fastened to the arm holder 300, thereby enabling the main arm 110 to be fixed to the arm holder 300. The fastening protrusion 182 may be disposed in a plurality along an outer circumferential surface of the arm holder coupling unit 180.

The main arm 110 may include a plurality of inlets 138*a*, 138*b*, 138*c*, and 138*d* through which the wash water supplied from the arm holder 300 is introduced. The plurality of inlets 138*a*, 138*b*, 138*c*, and 138*d* may be disposed at the lower frame 130.

The plurality of inlets 138*a*, 138*b*, 138*c*, and 138*d* may include a first inlet 138*a* communicating with the first main flow passage 117, and a second inlet 138*b* communicating with the second main flow passage 118. The wash water introduced through the first inlet 138*a* flows to the first main flow passage 117 to be sprayed through the spray holes 123 and 133 disposed in the first arm 113, and the wash water introduced through the second inlet 138*b* flows to the second main flow passage 118 to be sprayed through the spray holes 124 and 134 disposed in the second arm 114.

The plurality of inlets 138*a*, 138*b*, 138*c*, and 138*d* may include a third inlet 138*c* communicating with the first outlet 111*a*, and a fourth inlet 138*d* communicating with the second outlet 112*b*.

The first transfer flow passage may be formed by the communication between the first outlet 111*a* and the third inlet 138*c*, and the second transfer flow passage may be formed by the communication between the second outlet 112*b* and the fourth inlet 138*d*. The first transfer flow passage and the second transfer flow passage may be divided from each other by the partition 116.

The wash water introduced through the third inlet 138*c* flows to the first auxiliary arm 140 via the first transfer flow passage to be sprayed through the spray holes 143 and 144 disposed in the first auxiliary arm 140, and the wash water introduced through the fourth inlet 138*d* flows to the second auxiliary arm 150 via the second transfer flow passage to be sprayed through the spray holes 153 and 154 disposed in the second auxiliary arm 150.

An upper gear engaging unit 139 to which an upper gear of the flow passage switching unit 400 is engaged may be disposed at the lower frame 130. The upper gear engaging unit 139 may be configured to rotate the flow passage switching unit 400 by a predetermined angle. The flow passage switching unit 400 may open or close each of the inlets 138*a*, 138*b*, 138*c*, and 138*d* as the flow passage switching unit 400 is engaged with the upper gear engaging unit 139. A principle of the flow passage switching unit 400 opening or closing the plurality of inlets 138*a*, 138*b*, 138*c*, and 138*d* will be described in detail below.

The auxiliary arm connection member 160 may include an insertion tube 162 inserted into the main arm 110, an extension tube 164 communicating with the insertion tube 162 to have the wash water introduced from the insertion tube 162 flow therethrough, a shaft 166 connected to the extension tube 164, and a protrusion 168 protruding from the shaft 166.

A flow hole 167 may be formed between the extension tube 164 and the shaft 166. The wash water introduced into the insertion tube 162 may be discharged through the flow hole 167 via the extension tube 164. The wash water discharged through the flow hole 167 may flow to the inner spaces of the auxiliary arms 140 and 150 to be sprayed through the spray holes.

The spray arm 100 may not include the auxiliary arm connection member 160. In this example, the auxiliary arms 140 and 150 may be directly and rotatably connected to the main arm 110. The sagging of the auxiliary arms 140 and 150 may be prevented since loads of end portions thereof are supported by the auxiliary arm connection members 160.

Figure 7:
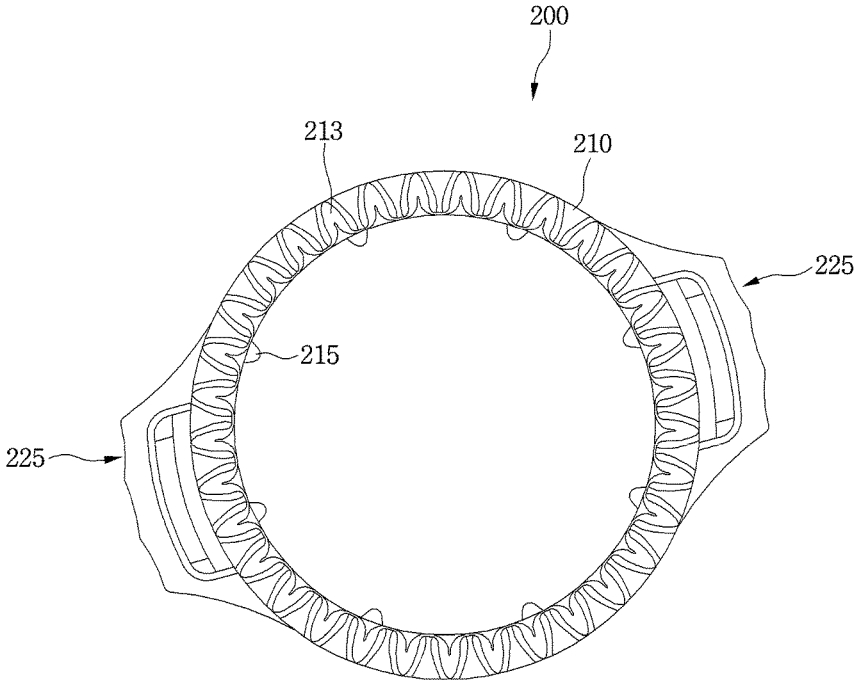
FIG. 7 is a plan view of an example of a fixed gear unit of FIG. 3.
Figure 8:
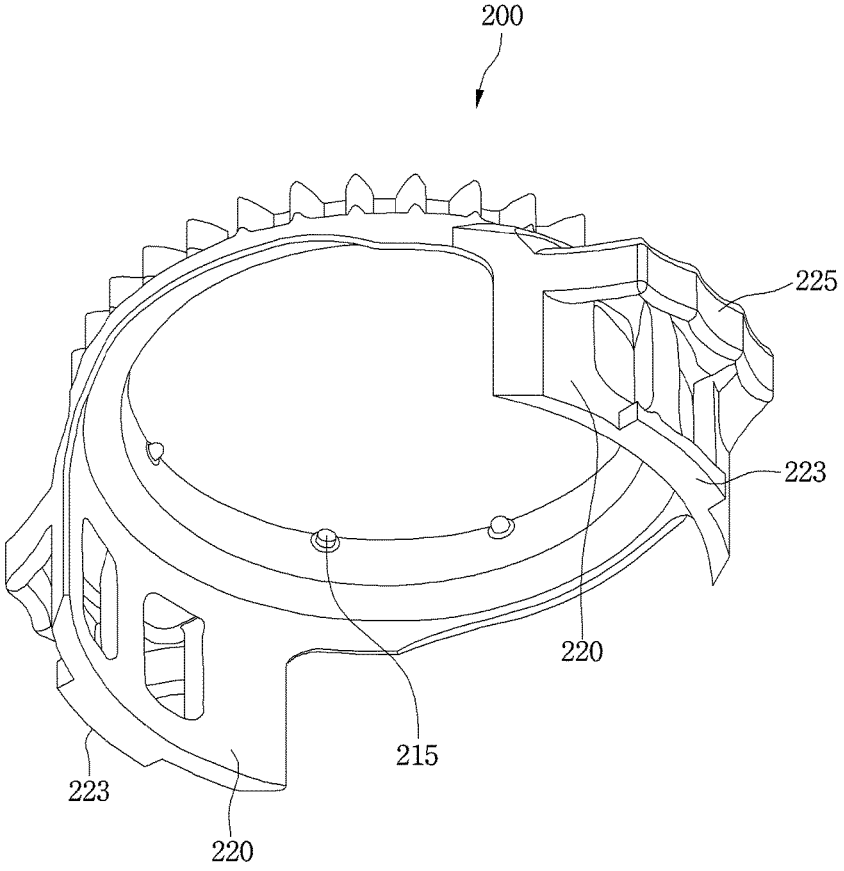
FIG. 8 illustrates an example of the fixed gear unit of FIG. 7.

Referring to FIGS. 7 and 8, the fixed gear unit 200 may include a rim part 210 including a plurality of gear teeth 213, and a support part 220 extending downward from the rim part 210. The arm holder coupling unit 180 may be inserted into the rim part 210. The plurality of gear teeth 213 may be referred to as a first gear unit 213.

The rim part 210 may include a gap reduction protrusion 215 to reduce a gap between the rim part 210 and the arm holder coupling unit 180. The gap reduction protrusion 215 may be provided in a plurality and may protrude toward a center of the rim part 210.

The support part 220 may be disposed at both sides of the rim part 210. The support part 220 may include the fastening part 223 coupled to the sump cover 20. The fastening part 223 may be formed of a protrusion protruding from a side surface of the support part 220. The fastening part 223 may be fastened to the sump cover 20, thereby enabling the fixed gear unit 200 to be fixed to the sump cover 20.

The support part 220 may further include a handle part 225 that may be gripped when coupling or detaching the fixed gear unit 200 to or from the sump cover 20. The handle part 225 may extend in a radial direction of the fixed gear unit 200. At least a portion of a surface of the handle part 225 may be protruded or recessed for a user to easily grip the handle part 225.

Figure 9:
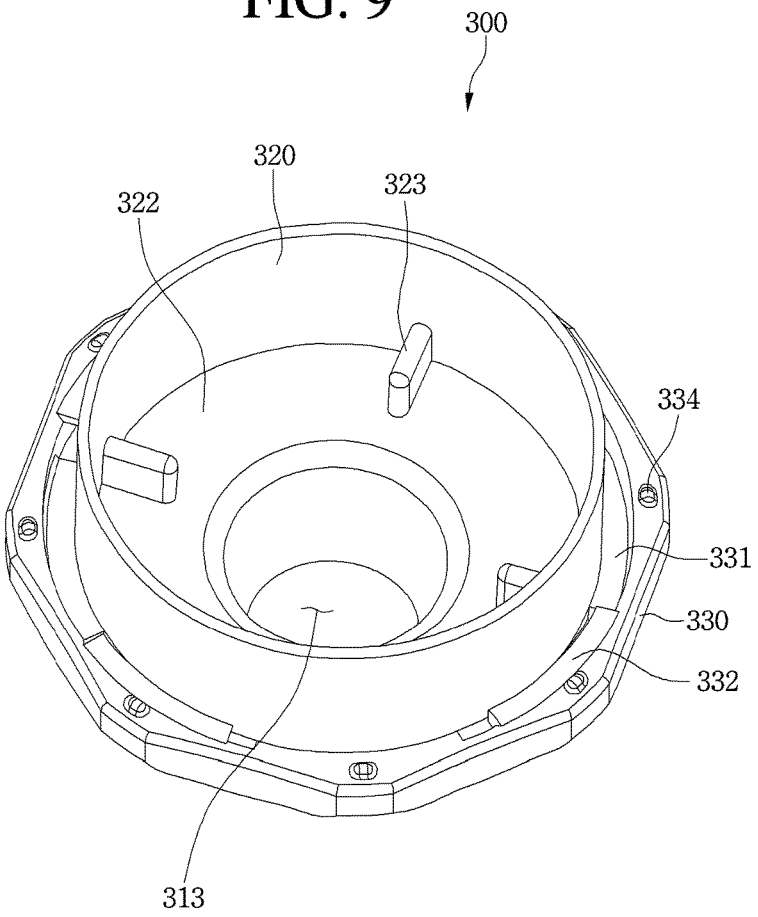
FIG. 9 is a perspective view of an example of an arm holder of FIG. 3.
Figure 10:
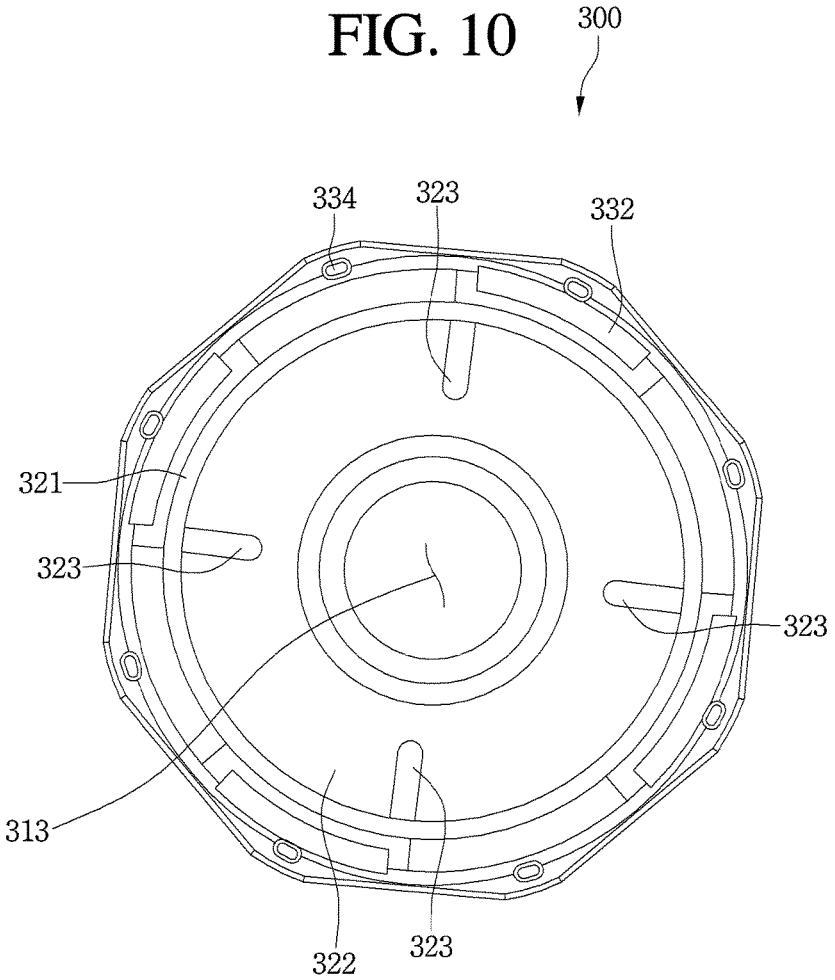
FIG. 10 is a plan view of an example of the arm holder of FIG. 9.
Figure 11:
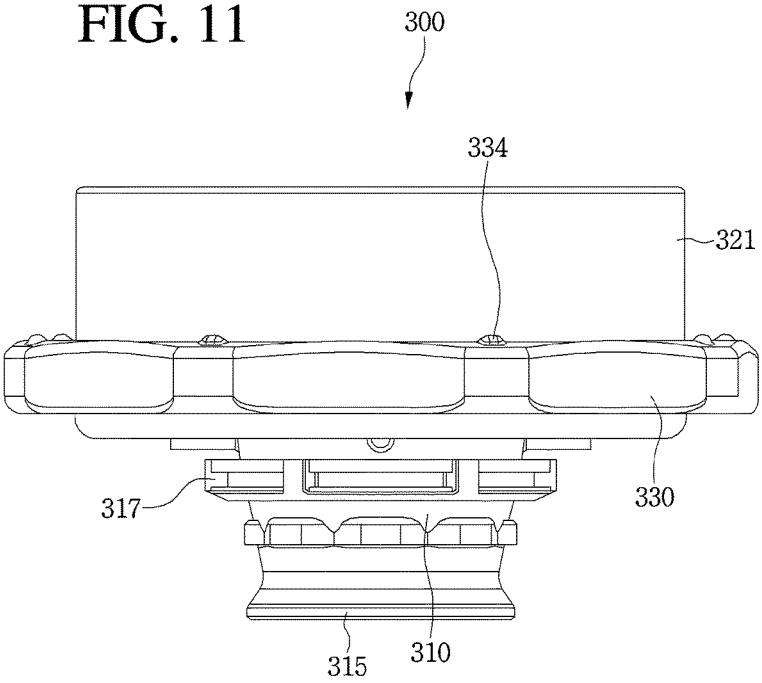
FIG. 11 is a side view of an example of the arm holder of FIG. 10.

Referring to FIGS. 9 to 11, the arm holder 300 may include an introduction unit 310 into which the wash water stored in the sump 5 is introduced, the arm holder chamber 320 communicating with the introduction unit 310, and supplying the wash water introduced from the introduction unit 310 to the spray arm 100, and a coupling unit 330 for coupling to the spray arm 100.

A wash water inlet 313 through which the wash water stored in the sump 5 is supplied may be formed at the introduction unit 310. Accordingly, the wash water stored in the sump 5 may be introduced into the arm holder 300 via the wash water inlet 313.

The introduction unit 310 may include the departure prevention part 315 to prevent the arm holder 300 from departing from the sump cover 20. The departure prevention part 315 may be formed by an end portion of the introduction unit 310 being flared. The departure prevention part 315 may be fastened to the sump cover 20 by the arm holder fastening part 23 (refer to FIG. 20) to be described below. The introduction unit 310 may be rotatably fixed to the sump cover 20.

The introduction unit 310 may further include a sealing unit 317 to prevent the leakage of the wash water introduced from the sump 5. The sealing unit 317 may be formed of ribs formed along an outer circumferential surface of the introduction unit 310. By the sealing unit 317, most of the wash water supplied from the sump 5 may be introduced into the arm holder 300.

The arm holder chamber 320 may include an inlet tube 321. The inlet tube 321 may be formed in a cylindrical shape, as illustrated. A hole communicating with the wash water inlet 313 may be formed on a bottom surface of the arm holder chamber 320. The arm holder chamber 320 may be accommodated in the arm holder coupling unit 180. An outer circumferential surface of the arm holder chamber 320 may come in contact with an inner circumferential surface of the arm holder coupling unit 180. A space between the arm holder coupling unit 180 and the arm holder chamber 320 may be sealed, thereby preventing the leakage of the wash water introduced into the spray arm 100 from the arm holder 300.

The flow passage switching unit 400 may be accommodated in the arm holder chamber 320. The wash water introduced into the arm holder chamber 320 may be selectively introduced through the plurality of inlets 138*a*, 138*b*, 138*c*, and 138*d* by the flow passage switching unit 400.

A lower gear engaging unit 323 engaged with a lower gear of the flow passage switching unit 400 may be disposed at the arm holder chamber 320. The lower gear engaging unit 323 may be coupled to the lower gear of the flow passage switching unit 400 and serve to rotate the flow passage switching unit 400 by a predetermined angle.

The lower gear engaging unit 323 may be disposed in a plurality along an edge of a bottom surface 322 of the arm holder chamber 320. Specifically, four lower gear engaging units 323 may be provided and may be disposed at 90° intervals with respect to the wash water inlet 313.

The coupling unit 330 may be disposed at the outer circumferential surface of the arm holder chamber 320. The coupling unit 330 may include a seating unit 331 on which the arm holder coupling unit 180 is seated, the fastening protrusion accommodation unit 332 disposed at the seating unit 331 and coupled to the fastening protrusion 182, and a gap reduction protrusion 334 disposed at an outer circumferential surface of the coupling unit 330 to reduce a gap with the fixed gear unit 200.

Figure 12:
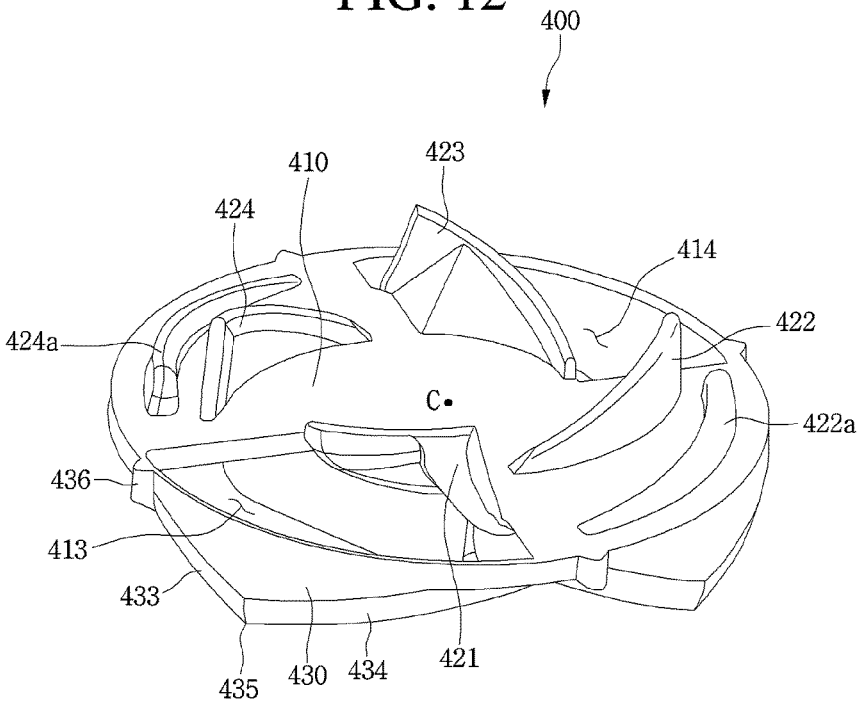
FIG. 12 is a perspective view of an example of a flow passage switching unit of FIG. 3.
Figure 13:
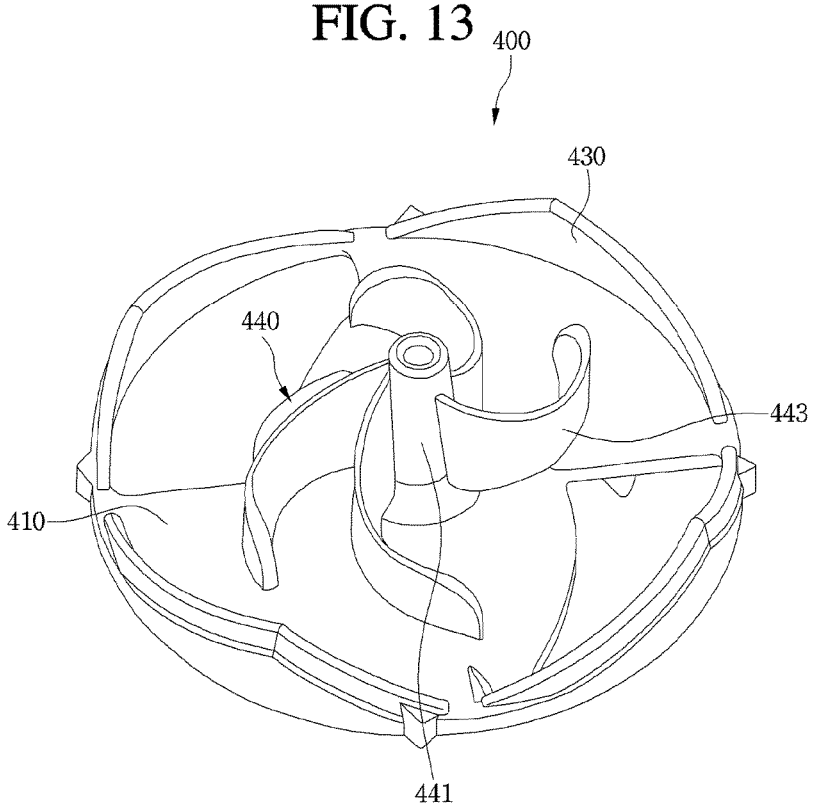
FIG. 13 illustrates an example of the flow passage switching unit of FIG. 12.

Referring to FIGS. 12 and 13, the flow passage switching unit 400 according to an implementation includes a switching unit main body 410, an upper gear disposed at an upper surface of the switching unit main body 410, and a lower gear 430 disposed at a lower surface of the switching unit main body 410. The upper gear may include a plurality of upper gears 421, 422, 423, and 424.

The switching unit main body 410 may be accommodated in the inlet tube 321 of the arm holder chamber 320, and may vertically move back and forth in the arm holder chamber 320 in accordance with the hydraulic pressure in the arm holder chamber 320. The switching unit main body 410 may be formed in a disk shape to correspond to a cross-sectional shape of the inlet tube 321.

Opening holes 413 and 414 through which the wash water introduced into the arm holder chamber 320 flows may be disposed in the switching unit main body 410. When the plurality of upper gears 421, 422, 423, and 424 are engaged with the upper gear engaging unit 139, the opening holes 413 and 414 may communicate with any one of the plurality of inlets 138*a*, 138*b*, 138*c*, and 138*d*.

The plurality of upper gears 421, 422, 423, and 424 being provided may be disposed at 90° intervals with respect to a center C of the switching unit main body 410.

In addition, the plurality of upper gears 421, 422, 423, and 424 may be spaced a predetermined distance apart from the center C of the switching unit main body 410, and an edge portion of the switching unit main body 410. The opening holes 413 and 414 may be respectively formed between the two upper gears 421 and 423 facing each other and the edge portion of the switching unit main body 410.

The plurality of upper gears 421, 422, 423, and 424 may include first and third upper hears 421 and 423 disposed adjacent to the opening holes 413 and 414, and second and fourth upper gears 422 and 424 disposed to face each other between the first and third upper gears 421 and 423.

Introduction prevention units 422*a* and 424*a* may be configured to come in close contact with the plurality of inlets 138*a*, 138*b*, 138*c*, and 138*d* to prevent the wash water from being introduced through the plurality of inlets 138*a*, 138*b*, 138*c*, and 138*d* may be formed at one side of each of the second and fourth upper gears 422 and 424.

The lower gear 430 may be engaged with the lower gear engaging unit 323 disposed at the arm holder chamber 320. Four lower gears 430 may be provided, and may be disposed at 90° intervals with respect to the center C of the switching unit main body 410.

Each of the lower gears 430 may include two inclined surfaces 433 and 434 and a peak 435 formed between the two inclined surfaces 433 and 434. Each of the inclined surfaces 433 and 434 may extend by 45° from a circumference of the switching unit main body 410.

The flow passage switching unit 400 may further include a protrusion 436 disposed at a side surface portion of the switching unit main body 410 to prevent a foreign substance from being caught between the flow passage switching unit 400, and the inner circumferential surface of the arm holder chamber 320. The protrusion 436 may be provided in a plurality. The protrusion 436 may also be disposed at a side surface portion of the lower gear 430.

The flow passage switching unit 400 may include a rotary unit 440 disposed at a bottom surface portion of the switching unit main body 410. The rotary unit 440 may be configured to enable the flow passage switching unit 400 to rotate by the wash water introduced through the bottom surface of the flow passage switching unit 400. The flow passage switching unit 400 may rotate by predetermined angle units by the hydraulic pressure without a separate driving device and selectively open and close the plurality of inlets 138*a*, 138*b*, 138*c*, and 138*d*. The rotary unit 440 may include a shaft 441 and an impeller 443 disposed at the shaft 441.

Figure 14:
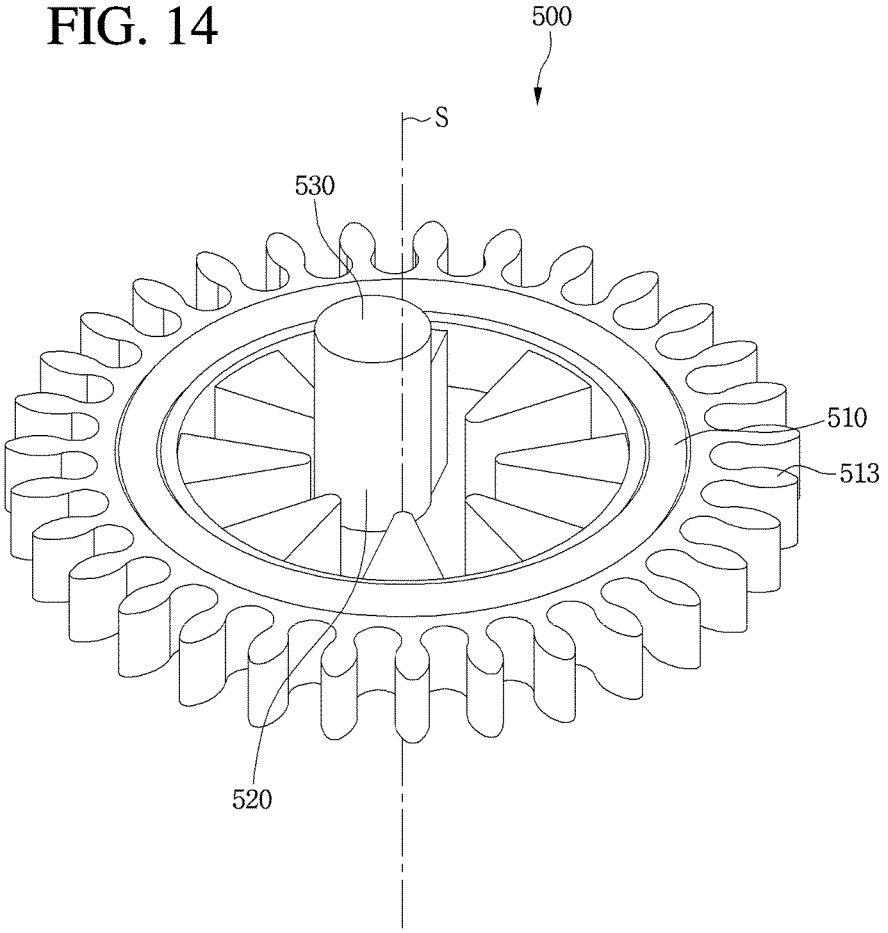
FIG. 14 is a perspective view of an example of a rotary gear unit of FIG. 3.

Referring to FIG. 14, the rotary gear unit 500 may include a rim part 510 having a plurality of gear teeth 513 disposed along an outer circumferential surface thereof, a rotation shaft accommodation unit 520 in which the gear rotation shaft 135 may be accommodated, and the eccentric protrusion 530 inserted into the link member 600 to move the link member 600 back and forth. The plurality of gear teeth 513 may be referred to as a second gear unit 513.

The rotation shaft accommodation unit 520 may be disposed in the rim part 510, and have the gear rotation shaft 135 inserted thereinto. The rotation shaft accommodation unit 520 may extend toward an upper side of the rotary gear unit 500 (a lower side of the rotary gear unit in FIG. 14).

The eccentric protrusion 530 may be disposed at a bottom surface of the rotation shaft accommodation unit 520 (the upper side of the rotary gear unit in FIG. 14). The eccentric protrusion 530 may extend from the bottom surface of the rotary gear unit 500 in a direction of a rotation axis s of the rotary gear unit 500. The rotation axis s corresponds to a center of rotation of the rotary gear unit 500, and may be provided at the center of the rim part 510. In some examples, the eccentric protrusion 530 may also be disposed at the rim part 510.

Figure 15:
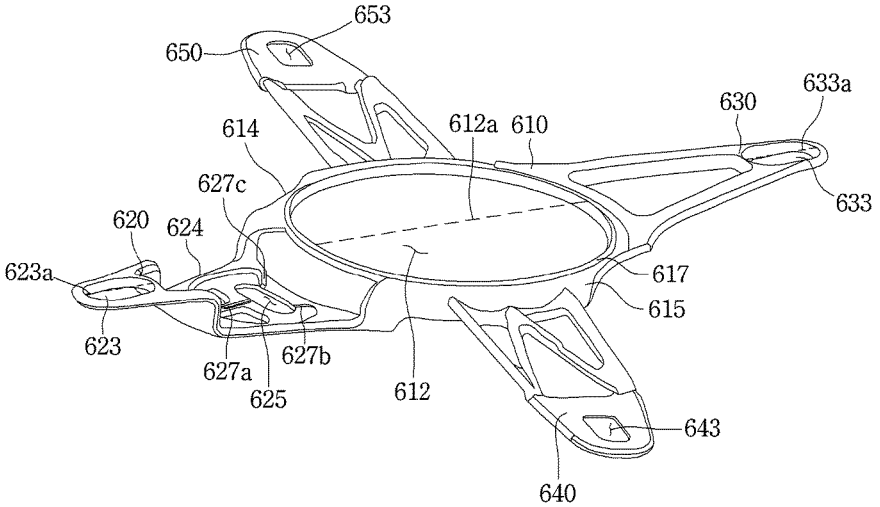
FIG. 15 is a perspective view of an example of a link member of FIG. 3.
Figure 16:
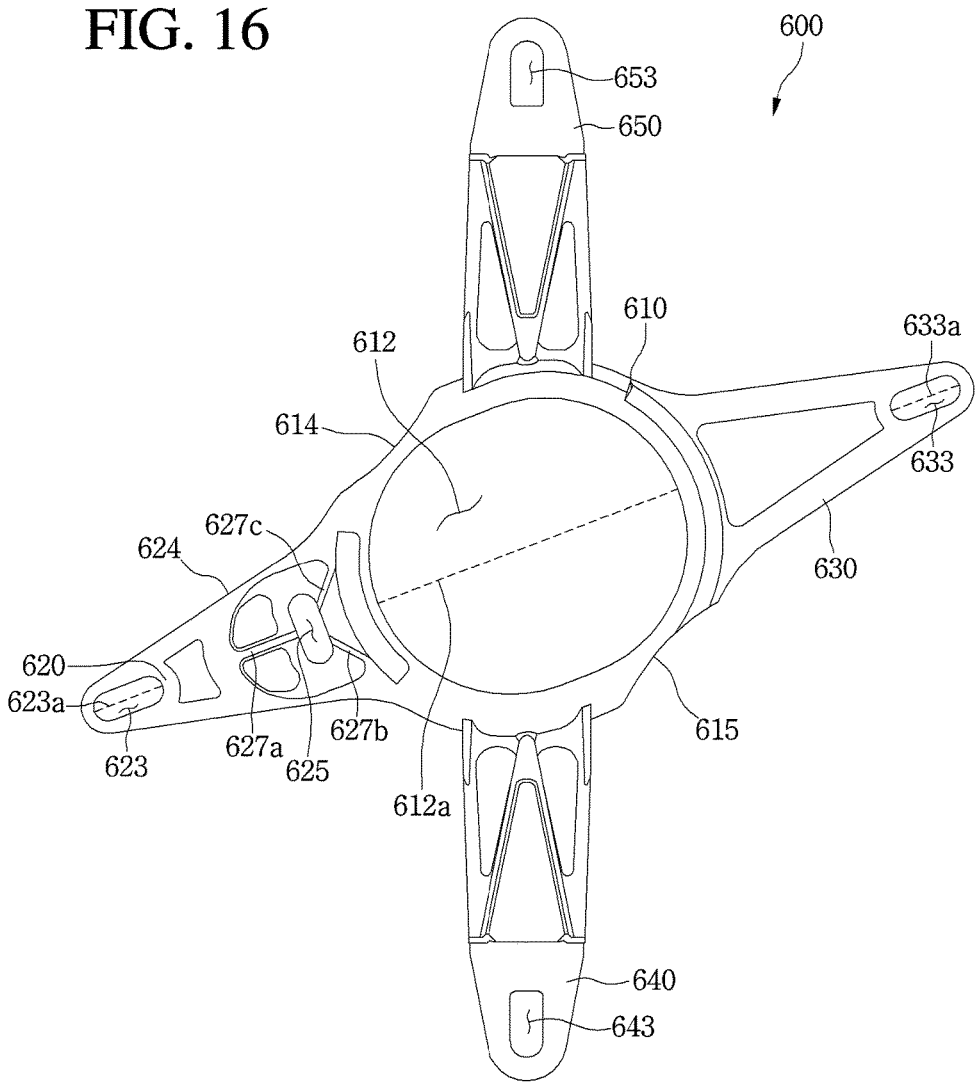
FIG. 16 is a plan view of an example of the link member of FIG. 15.

Referring to FIGS. 15 and 16, the link member 600 may include a ring-shaped rim part 610, and a plurality of extension parts 620, 630, 640, and 650 extending in a radial direction from the rim part 610.

An insertion hole 612 into which the arm holder coupling unit 180 may be inserted may be formed at the rim part 610. The insertion hole 612 may be formed in an oval shape. The arm holder coupling unit 180 may move along a direction of a longitudinal axis 612*a* of the insertion hole 612.

Notch units 614 and 615 may be formed in an outer circumferential surface of the rim part 610. The notch units 614 and 615 may be formed such that the shape of the link member 600 corresponds to the shape of the spray arm 100. Also, by forming the notch units 614 and 615, a user is enabled to easily grip the link member 600.

The rim part 610 may further include a reinforcement rib 617 to reinforce the strength of the rim part 610. The reinforcement rib 617 may be formed along a circumferential direction of the rim part 610 and may protrude upward.

The plurality of extension parts 620, 630, 640, and 650 may include a first main extension part 620 located below the first arm 113, a second main extension part 630 located below the second arm 114, a first auxiliary extension part 640 located below the first auxiliary arm 140, and a second auxiliary extension part 650 located below the second auxiliary arm 150.

A first guide part 623 into which the first guide protrusion 136 may be inserted may be formed in the first main extension part 620, and a second guide unit 633 into which the second guide protrusion 137 may be inserted may be formed in the second main extension part 630. The first and second guide protrusions 136 and 137 respectively, may move back and forth along directions of longitudinal axes 623*a* and 633*a* of the first and second guide parts 623 and 633, while being inserted into the first and second guide parts 623 and 633.

A first locking part 643 into which the first power transfer unit 146 may be inserted may be formed in the first auxiliary extension part 640, and a second locking part 653 into which the second power transfer unit 156 may be inserted may be formed in the second auxiliary extension part 650. Since the first and second power transfer units 146 and 156 are respectively inserted into the first and second locking parts 643 and 653, the movement of the link member 600 may be transferred to the auxiliary arms 140 and 150 via the power transfer units 146 and 156.

The first main extension part 620 may further include a recessed part 624 configured to avoid interfering with the rotary gear unit 500. An insertion part 625 into which the eccentric protrusion 530 of the rotary gear unit 500 may be inserted may be formed in the recessed part 624. The insertion part 625 may be formed in a shape of a long hole as illustrated. In some examples, the insertion part 625 may be formed in a shape of a long groove.

The first main extension part 620 may further include contact units 627*a*, 627*b*, and 627*c* coming in contact with the rim part 510 of the rotary gear unit 500. The contact units 627*a*, 627*b*, and 627*c* may be formed of a rib protruding from a surface of the recessed part 624. The contact units 627*a*, 627*b*, and 627*c* may be disposed such that a contact area between the rotary gear unit 500 and the first main extension part 620 is reduced. Accordingly, friction generated between the rotary gear unit 500 and the first main extension part 620 when the rotary gear unit 500 rotates may be decreased.

Figure 17:
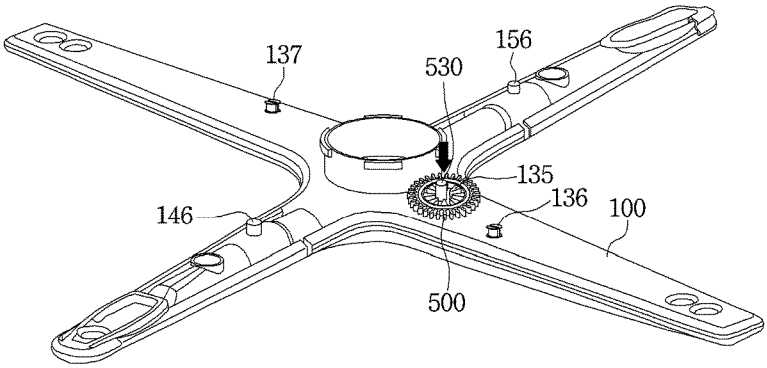
FIGS. 17 to 20 are views illustrating an example of an order of assembling the spray arm assembly of FIG. 3.

Referring to FIGS. 17 to 20, the spray arm 100 may be first coupled to the rotary gear unit 500 (refer to FIG. 17). The rotary gear unit 500 may be inserted into the gear rotation shaft 135 disposed at the spray arm 100.

Figure 18:
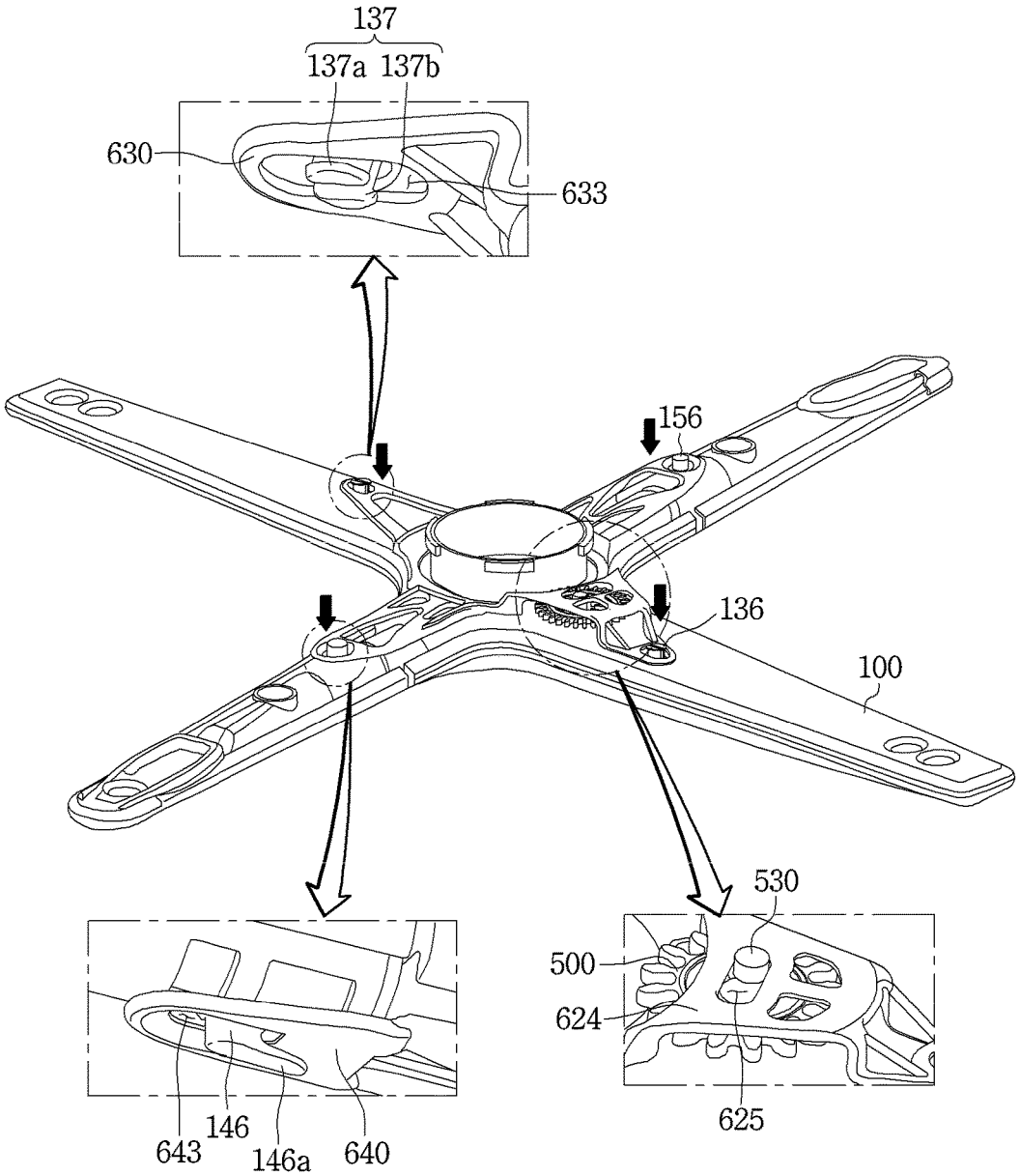

The link member 600 may be additionally mounted on the spray arm 100 (refer to FIG. 18). The link member 600 may be first connected to the power transfer units 146 and 156, and then connected by the guide protrusions 136 and 137. The link member 600 may be connected to four points of the spray arm 100. The eccentric protrusion 530 of the rotary gear unit 500 may be inserted into the insertion part 625 of the recessed part 624.

The first power transfer unit 146 may be inserted into the first locking part 643. The first power transfer unit 146 may include a departure prevention rib 146*a* to prevent the power transfer unit 146 from departing from the first locking part 643. The departure prevention rib 146*a* may extend toward the center of the spray arm 100 as illustrated. The second power transfer unit 156 may include a departure prevention rib with the same shape as the departure prevention rib 146*a* disposed in the first power transfer unit 146.

The second guide protrusion 137 may be inserted into the second guide unit 633. The second guide protrusion 137 may be formed of two elastic bodies 137*a* and 137*b* as illustrated. End portions of the two elastic bodies 137*a* and 137*b* may extend along a horizontal direction to prevent the second guide protrusion 137 from departing from the second guide unit 633. When the second guide protrusion 137 is inserted into the second guide unit 633, the two elastic bodies 137*a* and 137*b* may be bent in directions approaching each other. After the second guide protrusion 137 is inserted into the second guide unit 633, the two elastic bodies 137*a* and 137*b* are restored to original states due to elasticity. The first guide protrusion 136 may be formed with the same shape as the second guide protrusion 137.

Figure 19:
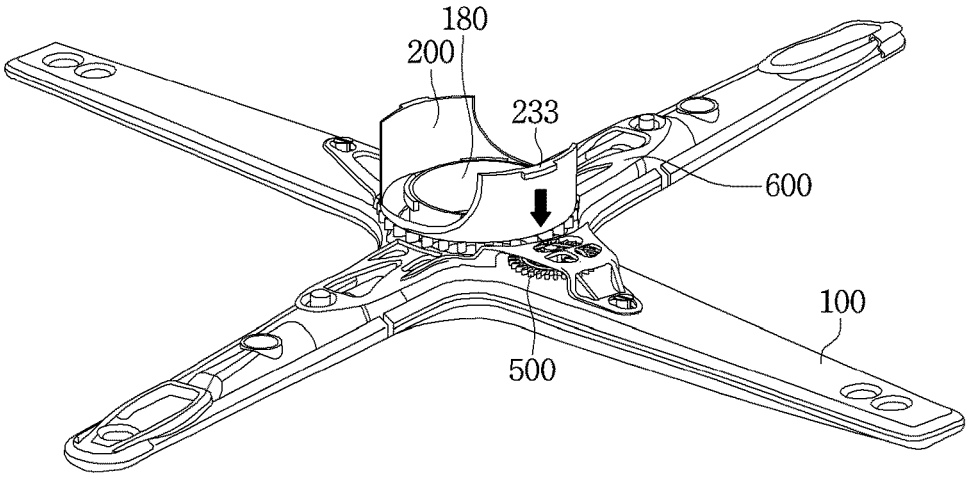

The fixed gear unit 200 may be additionally coupled to the spray arm 100 (refer to FIG. 19). The fixed gear unit 200 may be mounted to surround the circumference of the arm holder coupling unit 180. The arm holder coupling unit 180 may be inserted into the rim part 210 of the fixed gear unit 200. The gear teeth of the fixed gear unit 200 may be engaged with the gear teeth of the rotary gear unit 500. The fastening part 223 may be fastened to the sump cover 20 such that the fixed gear unit 200 is fixed to the sump cover 20.

The number of the gear teeth of the fixed gear unit 200 and the number of the gear teeth of the rotary gear unit 500 may be designed to be relatively prim parte. Accordingly, after the rotary gear unit 500 makes one revolution around the circumference of the fixed gear unit 200, the rotary gear unit 500 and the fixed gear unit 200 are not engaged with each other at the same position.

Figure 20:
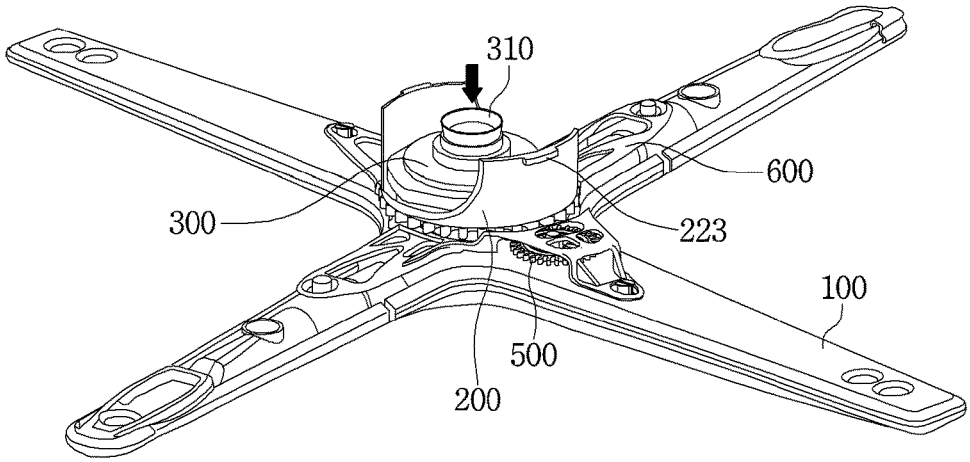

The arm holder 300 may be additionally coupled to the spray arm 100 (refer to FIG. 20). First, after the arm holder 300 is inserted into the arm holder coupling unit 180, the fastening protrusion 182 may be accommodated in the fastening protrusion accommodation unit 332 when the arm holder 300 is rotated by a predetermined angle. Accordingly, the arm holder 300 may be coupled to the arm holder coupling unit 180.

Figure 21:
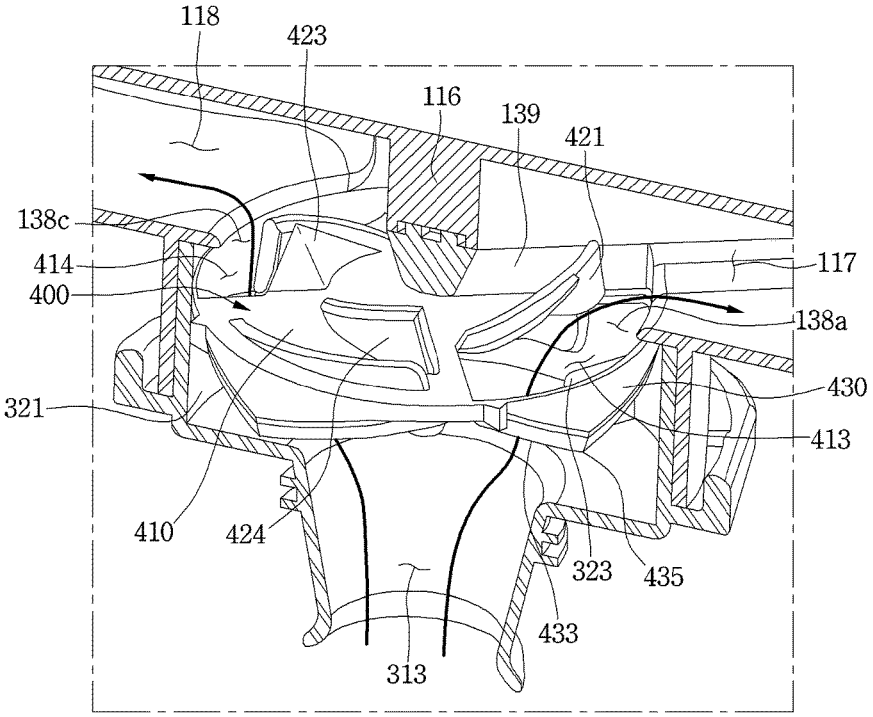
FIG. 21 is a view illustrating an example of a state in which an upper gear of the flow passage switching unit is engaged with the spray arm.
Figure 22:
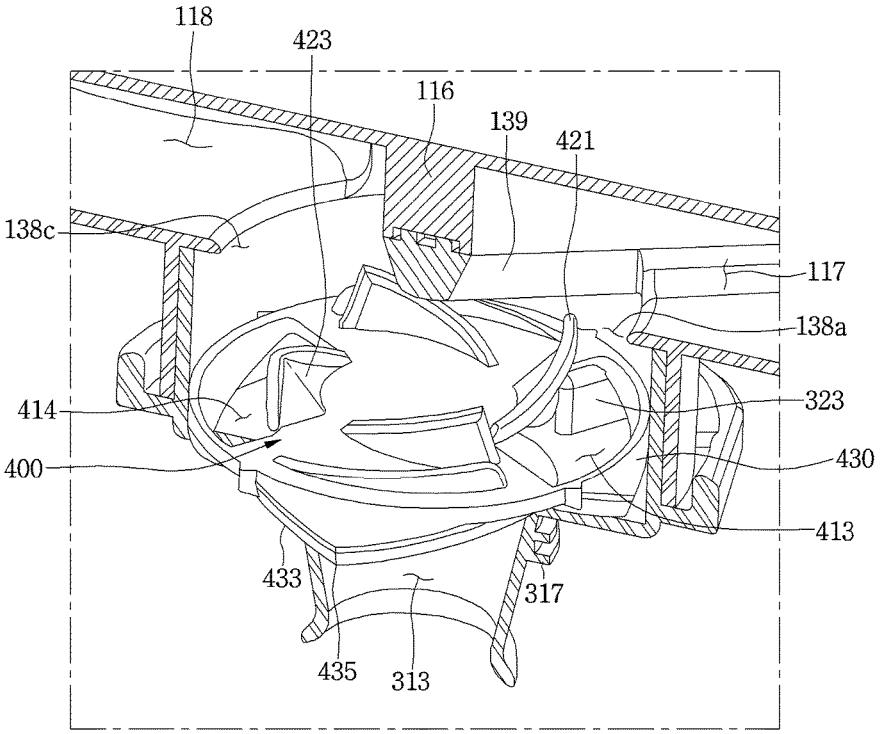
FIG. 22 is a view illustrating an example of a state in which a lower gear of the flow passage switching unit is engaged with the arm holder.

Referring to FIGS. 21 and 22, the flow passage switching unit 400 may be moved upward by the hydraulic pressure of the wash water introduced through the wash water inlet 313, and the plurality of upper gears 421, 422, 423, and 424 disposed at the flow passage switching unit 400 may be engaged with the upper gear engaging unit 139 disposed at the bottom surface of the spray arm 100. The wash water introduced into the inlet tube 321 may be introduced into the first main flow passage 117 via the first opening hole 413.

Simultaneously, the wash water introduced into the inlet tube 321 may be introduced into the second main flow passage 118 via the second opening hole 414. When the opening holes 413 and 414 communicate with the first and second inlets 138*a* and 138*b*, the wash water introduced into the inlet tube 321 may be simultaneously introduced into the main flow passages 117 and 118. Here, the third and fourth inlets 138*c* and 138*d* are closed by the switching unit main body 410. Accordingly, the introduction of the wash water through the first and second transfer flow passages is blocked. Simultaneously, the introduction of the wash water through the first and second auxiliary flow passages is also blocked.

When the introduction of the wash water through the wash water inlet 313 is stopped, force acting on the upper side of the flow passage switching unit 400 is removed and the flow passage switching unit 400 descends. Accordingly, the lower gear 430 disposed at the flow passage switching unit 400 is engaged with the lower gear engaging unit 323 disposed at the arm holder 300.

The flow passage switching unit 400 is rotated clockwise (or counterclockwise) by a predetermined angle due to the lower gear 430 being engaged with the lower gear engaging unit 323. Here, the flow passage switching unit 400 may be rotated by approximately 45°. This is due to the inclined surface 433 disposed at the lower gear 430 occupying as much as 45° of the circumference of the switching unit main body 410.

When the wash water is reintroduced through the wash water inlet 313 after the flow passage switching unit 400 descends, the flow passage switching unit 400 may ascend, causing the plurality of upper gears 421, 422, 423, and 424 to be re-engaged with the upper gear engaging unit 139. Here, the opening holes 413 and 414 may communicate with the third and fourth inlets 138*c* and 138*d* instead of the first and second inlets 138*a* and 138*b*. Accordingly, the wash water introduced into the inlet tube 321 is introduced through the third and fourth inlets 138*c* and 138*d* via the opening holes 413 and 414. The first and second inlets 138*a* and 138*b* are closed by the switching unit main body 410. Accordingly, the introduction of the wash water through the main flow passages 117 and 118 is blocked.

The sump 5 may intermittently supply the wash water when supplying the wash water through the wash water inlet 313. Specifically, the sump 5 may stop supplying the wash water for a predetermined amount of time after supplying the wash water to the arm holder 300 for a predetermined amount of time. That is, the sump 5 alternately performs the supplying of the wash water and the stopping of the supplying of the wash water. Consequently, as the flow passage switching unit 400 rotates while ascending and descending, the flow passage switching unit 400 may alternately open and close the main flow passages 117 and 118 and the first and second transfer flow passages.

In addition, a time during which the wash water is supplied to the main flow passages 117 and 118 through the sump and a time during which the wash water is supplied to the first and second transfer flow passages may be equally set.

Figure 23:
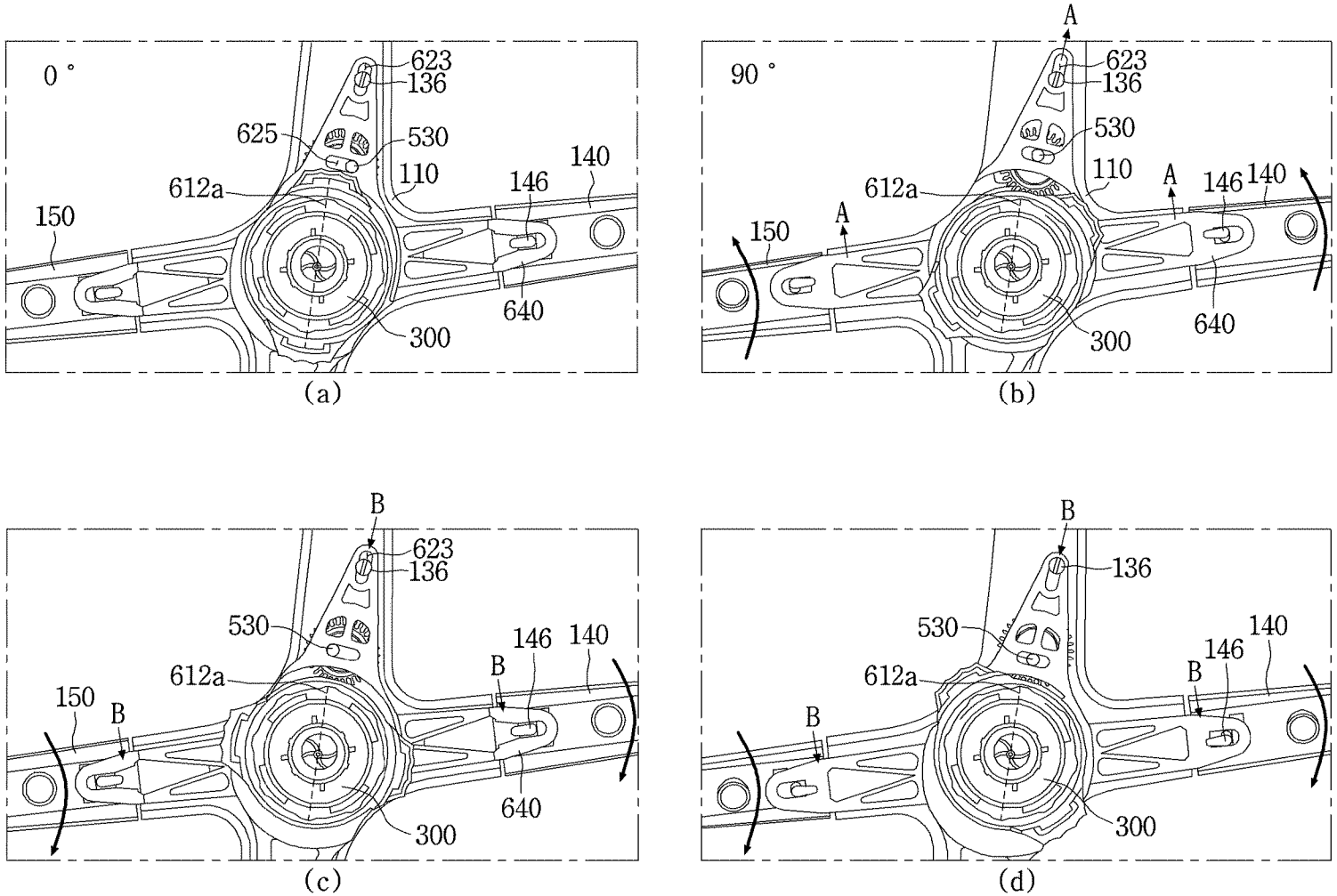
FIG. 23 is a view illustrating an example of the bottom surface of the spray arm assembly in accordance with a rotational angle of the rotary gear unit.
Figure 24:
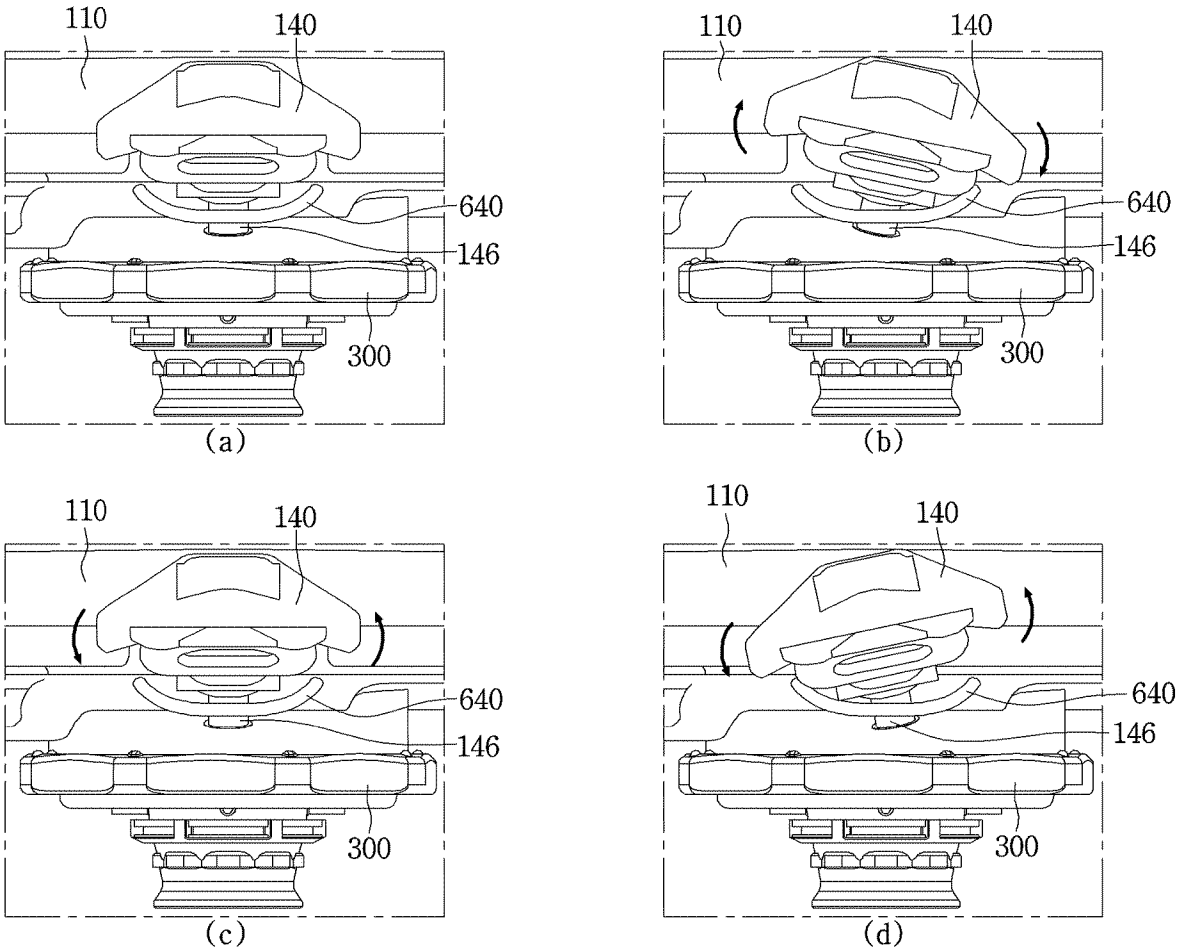
FIG. 24 is a side view of an example of the spray arm assembly of FIG. 23.
Figure 25:
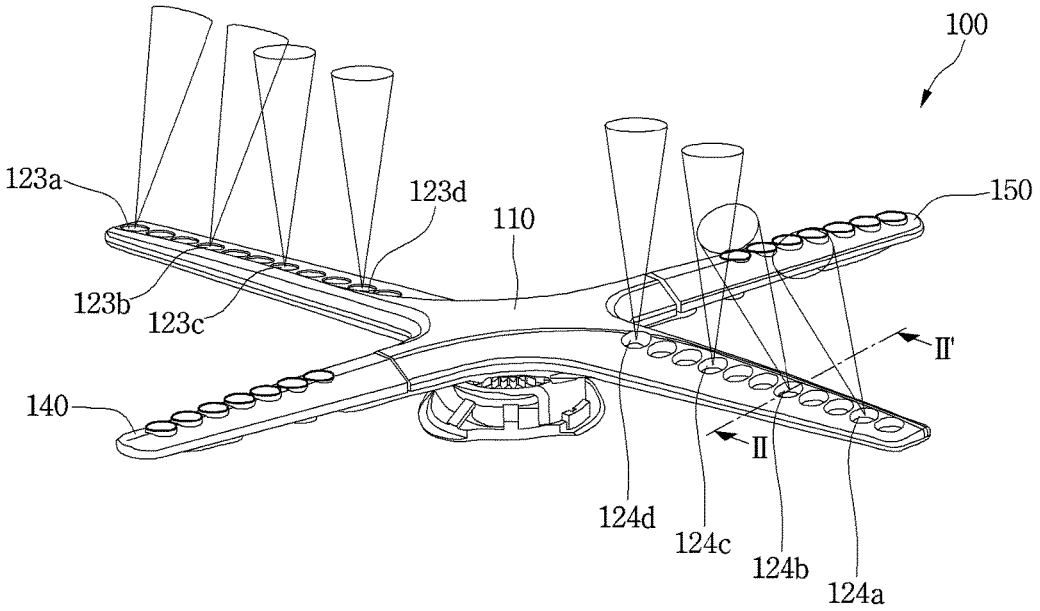
FIG. 25 is a view illustrating an example of a state in which wash water is sprayed through a main arm.
Figure 26:
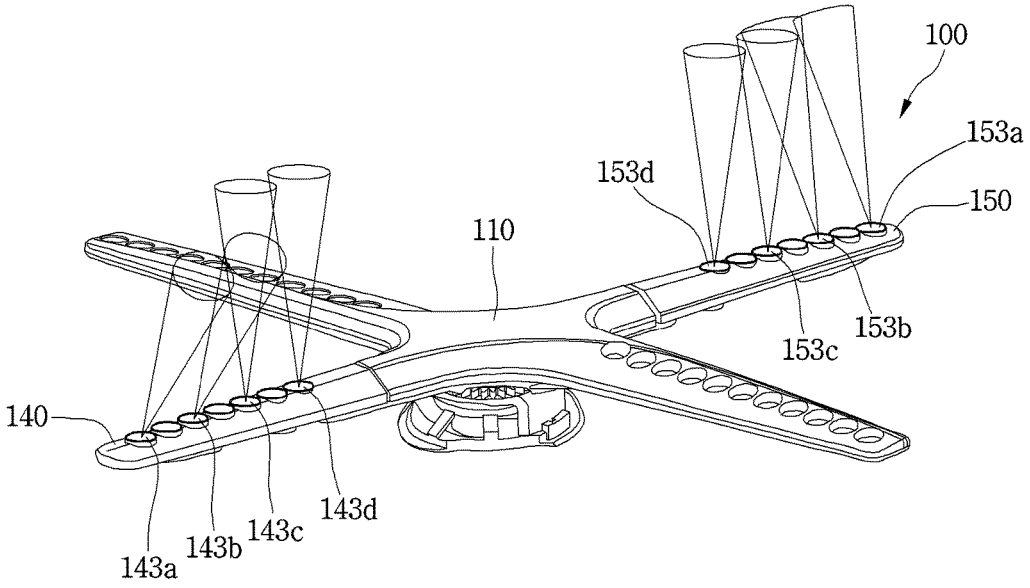
FIG. 26 is a view illustrating an example of a state in which the wash water is sprayed through auxiliary arms.

Referring to FIGS. 23(*a*) and 24(*a*), when the rotary gear unit 500 is in an initial unrotated state, the eccentric protrusion 530 is located at one side in the insertion part 625. Here, the first auxiliary arm 140 is disposed parallel to the main arm 110.

Referring to FIGS. 23(*b*) and 24(*b*), when the rotary gear unit 500 has rotated counterclockwise by 90°, the link member 600 moves along a direction A among directions of the longitudinal axis 612*a* by the eccentric protrusion 530.

The first auxiliary extension part 640 applies a force to the first power transfer unit 146 due to the link member 600 moving along a direction of the longitudinal axis 612*a*. Accordingly, the first auxiliary arm 140 may be rotated clockwise by a predetermined angle. A rotational angle of the first auxiliary arm 140 is approximately 20°.

Referring to FIGS. 23(*c*) and 24(*c*), when the rotary gear unit 500 has further rotated counterclockwise by 90°, the link member 600 moves along a direction B which is opposite from the direction A of the longitudinal axis 612*a*. Accordingly, the link member 600 may be restored to the position illustrated in FIGS. 23(*a*) and 24(*a*). Simultaneously, the first auxiliary arm 140 may be restored to an original position after rotating counterclockwise by the first auxiliary extension part 640.

Referring to FIGS. 23(*d*) and 24(*d*), when the rotary gear unit 500 has further rotated counterclockwise by 90°, the link member 600 moves along the direction B among the directions of the longitudinal axis 612*a* by the eccentric protrusion 530. Here, the first auxiliary arm 140 may be rotated counterclockwise by a predetermined angle. The rotational angle of the first auxiliary arm 140 is approximately 20°.

Meanwhile, the second auxiliary arm 150 may simultaneously rotate by the same angle as the first auxiliary arm 140 due to the link member 600. However, when viewed from the side, the second auxiliary arm 150 rotates along a direction opposite from the first auxiliary arm 140.

Thus, the link member 600 may move back and forth within a distance between a top dead point and a bottom dead point of the eccentric protrusion 530 due to the rotation of the rotary gear unit 500.

Since the fixed gear unit 200, the rotary gear unit 500, and the link member 600 interact with each other to rotate the auxiliary arms 140 and 150 back and forth, the fixed gear unit 200, the rotary gear unit 500, and the link member 600 may be collectively referred to as a 'rotation driving unit.'

Referring to FIGS. 25 to 28, the main arm 110 may include the plurality of upper spray holes. Specifically, the first arm 113 may include a plurality of first upper spray holes 123*a*, 123*b*, 123*c*, and 123*d*. The second arm 114 may also include a plurality of second upper spray holes 124*a*, 124*b*, 124*c*, and 124*d*. When the main flow passages 117 and 118 are opened by the flow passage switching unit 400, the wash water may be simultaneously sprayed through the plurality of first upper spray holes 123*a*, 123*b*, 123*c*, and 123*d* and the plurality of second upper spray holes 124*a*, 124*b*, 124*c*, and 124*d*.

At least a subset of the spray holes (123*a* and 123*b*) of the plurality of first upper spray holes 123*a*, 123*b*, 123*c*, and 123*d* may be biased such that a direction in which the wash water is sprayed forms an acute angle with the main arm 110.

Accordingly, the spray arm 100 may rotate by a repulsive force generated due to the wash water being sprayed through the biased spray holes 123*a* and 123*b*. That is, a predetermined torque value may be generated at the spray arm 100 due to the wash water being sprayed through the biased spray holes 123*a* and 123*b*.

The other spray holes 123*c* and 123*d* among the plurality of first upper spray holes 123*a*, 123*b*, 123*c*, and 123*d* are not biased and may spray the wash water in the vertical direction.

At least a few of the spray holes (124*a* and 124*b*) of the plurality of second upper spray holes 124*a*, 124*b*, 124*c*, and 124*d* may be biased such that the direction in which the wash water is sprayed forms an acute angle with the main arm 110.

Accordingly, the spray arm 100 may rotate by a repulsive force generated due to the wash water being sprayed through the biased spray holes 124*a* and 124*b*. That is, a predetermined torque value may be generated at the spray arm 100 due to the wash water being sprayed through the biased spray holes 124*a* and 124*b*.

The torque acting on the spray arm 100 due to the wash water being sprayed through the biased spray holes 123*a* and 123*b* of the plurality of first upper spray holes 123*a*, 123*b*, 123*c*, and 123*d* and the torque acting on the spray arm 100 due to the wash water being sprayed through the biased spray holes 124*a* and 124*b* of the plurality of second upper spray holes 124*a*, 124*b*, 124*c*, and 124*d* have the same direction.

Meanwhile, the biased spray holes 123*a* and 123*b* of the plurality of first upper spray holes 123*a*, 123*b*, 123*c*, and 123*d* and the biased spray holes 124*a* and 124*b* of the plurality of second upper spray holes 124*a*, 124*b*, 124*c*, and 124*d* may be biased to spray the wash water in a tangential direction of a rotational trajectory of the spray arm 100. In some examples, a rotary force caused by the spraying of the wash water may further increase.

The other spray holes 124*c* and 124*d* among the plurality of second upper spray holes 124*a*, 124*b*, 124*c*, and 124*d* are not biased and may spray the wash water in the vertical direction.

The plurality of first upper spray holes 123*a*, 123*b*, 123*c*, and 123*d* and the plurality of second upper spray holes 124*a*, 124*b*, 124*c*, and 124*d* may be biased at different angles to spray the wash water at various angles. When the transfer flow passages are opened by the flow passage switching unit 400, the wash water is sprayed through a plurality of first upper auxiliary spray holes 143*a*, 143*b*, 143*c*, and 143*d* and a plurality of second upper auxiliary spray holes 153*a*, 153*b*, 153*c*, and 153*d*.

Similar to the main arm 110, the first auxiliary arm 140 may also include biased spray holes 143*a* and 143*b* and unbiased spray holes 143*c* and 143*d*. The second auxiliary arm 150 may also include biased spray holes 153*a* and 153*b* and unbiased spray holes 153*c* and 153*d*.

The biased spray holes 143*a* and 143*b* disposed in the first auxiliary arm 140 may be referred to as first biased spray holes 143*a* and 143*b*, and the biased spray holes 153*a* and 153*b* disposed in the second auxiliary arm 150 may be referred to as second biased spray holes 153*a* and 153*b*. The unbiased spray holes 143*c* and 143*d* disposed in the first auxiliary arm 140 may be referred to as first vertical spray holes 143*c* and 143*d*, and the unbiased spray holes 153*c* and

153*d* disposed in the second auxiliary arm 150 may be referred to as second vertical spray holes 153*c* and 153*d*.

A torque generated due to the wash water being sprayed through the first biased spray holes 143*a* and 143*b* may act on the spray arm 100. A torque generated due to the wash water being sprayed through the second biased spray holes 153*a* and 153*b* may act on the spray arm 100.

Since the first auxiliary arm 140 and the second auxiliary arm 150 rotate in the same direction, a magnitude and a direction of the torque caused by the spraying of the wash water may change.

Figure 27:
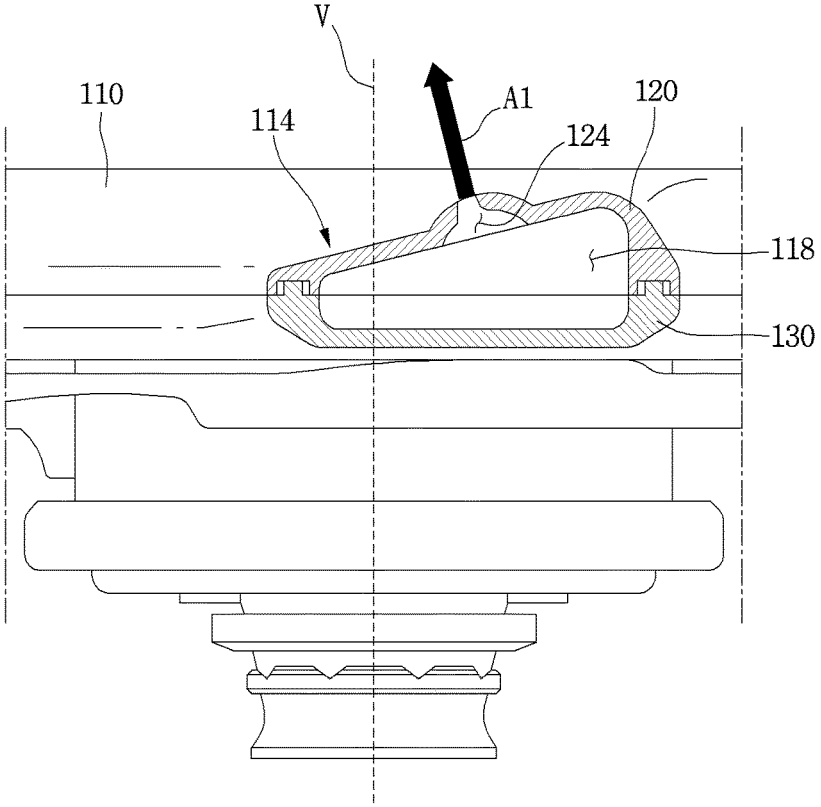
FIG. 27 is a cross-sectional view taken along line II-II' of FIG. 25.

The biased spray holes are referred to as the first upper spray holes 123 and the second upper spray holes 124 for convenience. FIG. 27 illustrates a direction in which the wash water is sprayed through the second upper spray holes 124 of the second arm 114.

The second main flow passage 118 formed between the upper frame 120 and the lower frame 130 may be formed in the second arm 114. The wash water introduced through the arm holder 300 may flow to the second main flow passage 118, and be sprayed to the outside through the second upper spray holes 124.

The second upper spray holes 124 may be biased to face a left upper portion. Accordingly, a direction A1 of the wash water being sprayed through the second upper spray holes 124 may also face the left upper portion.

The direction A1 in which the wash water is sprayed through the second upper spray holes 124 is biased to form an acute angle with a rotation axis v of the spray arm 100 as illustrated. Accordingly, the spray arm 100 may rotate by the torque generated due to the wash water being sprayed through the second upper spray holes 124.

The first upper spray holes 123 disposed in the first arm 113 may also be biased similar to the second upper spray holes 124. The torques generated due to the wash water being sprayed through the first upper spray holes 123 and the second upper spray holes 124 simultaneously act on the spray arm 100.

Since the wash water is sprayed through the plurality of spray holes, a plurality of torques act on the spray arm 100. Consequently, a rotational direction of the spray arm 100 may change in accordance with a resultant force of the torques caused by the wash water sprayed through the first upper spray holes 123 and the second upper spray holes 124. However, when directions of the torque caused by the wash water being sprayed through the first upper spray holes 123 and the torque caused by the wash water sprayed through the second upper spray holes 124 are the same, the rotary force of the spray arm 100 may be further reinforced.

Figure 28:
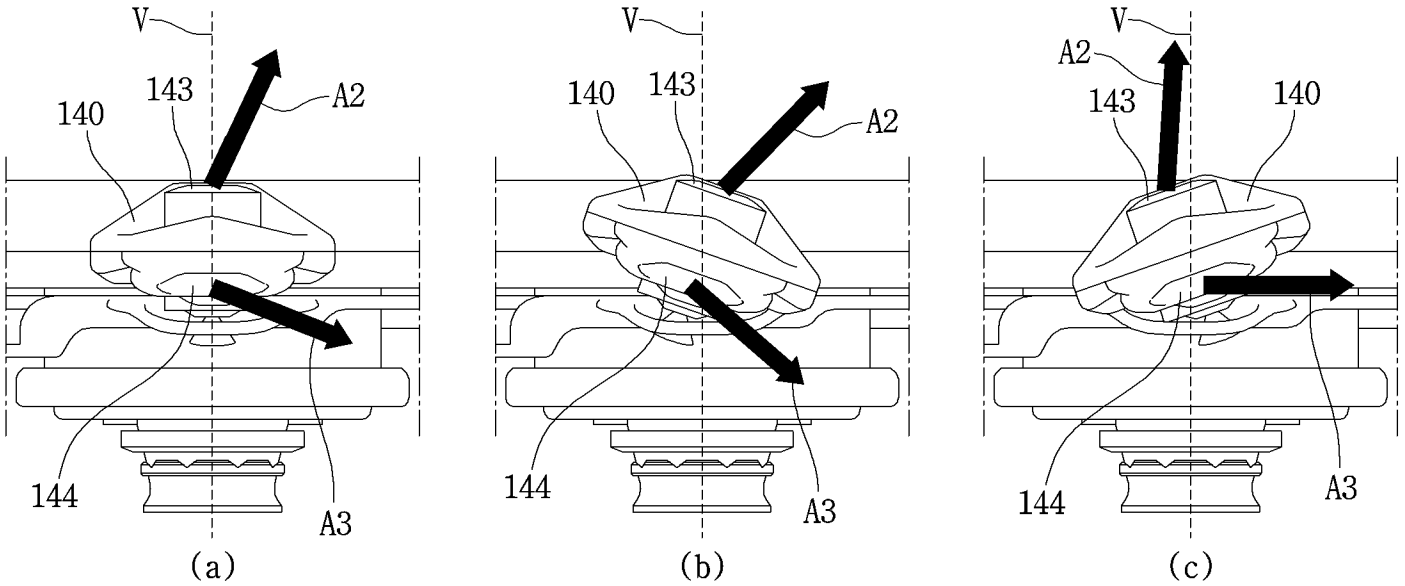
FIG. 28 is a view illustrating an example of a state in which the wash water is sprayed through the auxiliary arm and the auxiliary arm rotates back and forth at the same time.

Referring to FIG. 28(*a*), the wash water is simultaneously sprayed through the first upper auxiliary spray hole 143 and the first lower auxiliary spray hole 144. A direction A2 in which the wash water is sprayed through the first upper auxiliary spray hole 143, and a direction A3 in which the wash water is sprayed through the first lower auxiliary spray hole 144 may face a right upper portion based on the drawings.

The directions A2 and A3 in which the wash water is sprayed through the first upper auxiliary spray hole 143, and the first lower auxiliary spray hole 144 may form acute angles with the rotation axis v of the spray arm 100. A clockwise torque may be applied to the spray arm 100 due to the wash water being sprayed through the first upper auxiliary spray hole 143 and the first lower auxiliary spray hole 144.

Referring to FIG. 28(*b*), even when the first auxiliary arm 140 has maximally rotated clockwise, the directions A2 and A3 in which the wash water is sprayed through the first upper auxiliary spray hole 143 and the first lower auxiliary spray hole 144 may face a right side with respect to the rotation axis v of the spray arm 100. Consequently, even when the first auxiliary arm 140 has rotated clockwise, the clockwise torque may be applied to the spray arm 100.

Referring to FIG. 28(*c*), even when the first auxiliary arm 140 has maximally rotated counterclockwise, the directions A2 and A3 in which the wash water is sprayed through the first upper auxiliary spray hole 143 and the first lower auxiliary spray hole 144 may face a right side with respect to the rotation axis v of the spray arm 100. Consequently, even when the first auxiliary arm 140 has rotated counterclockwise, the clockwise torque may be applied to the spray arm 100.

However, the direction A2 in which the wash water is sprayed through the first upper auxiliary spray hole 143 may be almost parallel to the rotation axis v of the spray arm 100. In some examples, a problem is caused since a direction of the torque acting on the spray arm 100 may change.

Consequently, a rotational angle of the first auxiliary arm 140 should be smaller than a spraying angle of the first upper auxiliary spray hole 143. The spraying angle of the first upper auxiliary spray hole 143 refers to an angle formed by the direction A2 in which the wash water is sprayed through the first upper auxiliary spray hole 143 and the rotation axis v of the spray arm 100 when the first auxiliary arm 140 is unrotated.

In addition, the rotational angle of the first auxiliary arm 140 should be smaller than a spraying angle of the first lower auxiliary spray hole 144. The spraying angle of the first lower auxiliary spray hole 144 refers to an angle formed by the direction A3 in which the wash water is sprayed through the first lower auxiliary spray hole 144 and the rotation axis v of the spray arm 100 when the first auxiliary arm 140 is unrotated.

When the wash water is sprayed through the first vertical spray holes 143*c* and 143*d*, the rotation of the spray arm 100 may be almost unaffected. However, when the first auxiliary arm 140 rotates, a torque may act on the spray arm 100 due to the spraying of the wash water since a direction in which the wash water is sprayed through the first vertical spray holes 143*c* and 143*d* forms an acute angle with the spray arm 100.

Since the second auxiliary arm 150 also rotates by the same angle when the first auxiliary arm 140 rotates, directions in which the wash water is sprayed through the first vertical spray holes 143*c* and 143*d* and the wash water sprayed through the second vertical spray holes 153*c* and 153*d* may form the same angle. Consequently, even when the first auxiliary arm 140 and the second auxiliary arm 150 rotate, a torque value caused by the wash water being sprayed through the first vertical spray holes 143*c* and 143*d* and a torque value caused by the wash water being sprayed through the second vertical spray holes 153*c* and 153*d* are offset by each other.

Furthermore, since the first auxiliary arm 140 and the second auxiliary arm 150 simultaneously rotate by the same angle, the torque values may be offset by each other when the wash water sprayed through the first vertical spray holes 143*c* and 143*d* and the wash water sprayed through the second vertical spray holes 153*c* and 153*d* are parallel to each other. That is, the torque values acting on the spray arm 100 may be offset even when the wash water sprayed through the first vertical spray holes 143*c* and 143*d* and the wash water sprayed through the second vertical spray holes

153*c* and 153*d* are not perpendicular to each other as long as they are parallel to each other.

When the first auxiliary arm 140 and the second auxiliary arm 150 rotate, a spraying angle of the wash water decreases such that the maximum spraying height of the wash water may also decrease.

Consequently, the spray arm 100 may rotate counter-clockwise (this is referred to as 'forward rotation' or 'cone-way rotation') when the wash water is sprayed through the main spray holes 123 and 124, and the spray arm 100 may rotate clockwise (this is referred to as 'reverse rotation' or 'other-way rotation') when the wash water is sprayed through the auxiliary spray holes 143 and 153.

Figure 29:
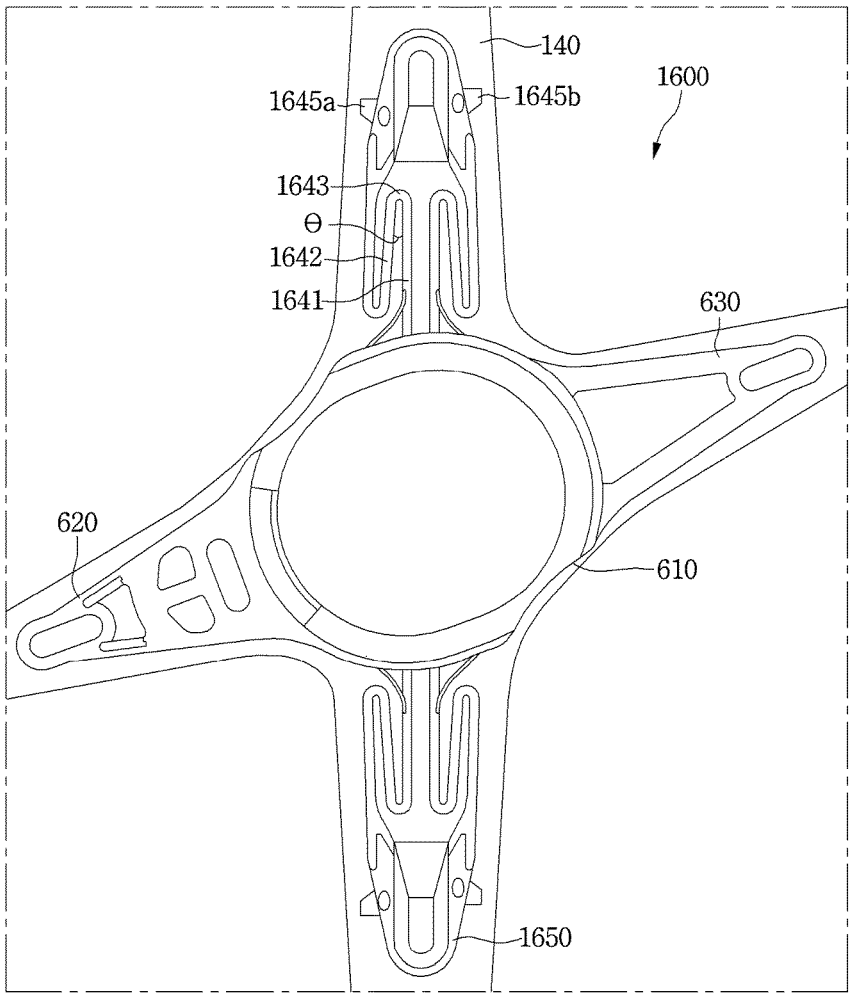
FIG. 29 is a view illustrating an example of a state in which a link member of a spray arm assembly implementation is mounted on a spray arm.

Referring to FIG. 29, the link member 1600 may include the ring-shaped rim part 610, and a plurality of extension parts 620, 630, 1640, and 1650 extending in the radial direction from the rim part 610.

The plurality of extension parts 620, 630, 1640, and 1650 may include a first auxiliary extension part 1640 and a second auxiliary extension part 1650 to rotate the auxiliary arms 140 and 150 back and forth. The first auxiliary extension part 1640 may include a first link 1641 extending from the rim part 610 and a second link 1642 connected to the first link 1641. That is, the first auxiliary extension part 1640 may be formed in a shape that may be bent several times.

A connection unit 1643 for connecting the first link 1641 to the second link 1642 may be elastically deformed so that an angle θ between the first link 1641 and the second link 1642 changes by increasing or. Accordingly, the first auxiliary extension part 1640 may be elastically deformed within a predetermined angle range in a horizontal direction.

The first link 1641 or the second link 1642 may be formed of a material that may be elastically deformed. For example, the first link 1641 or the second link 1642 may be formed of an engineering resin material. The first auxiliary extension part 1640 may be elastically deformed within the predetermined angle range in the horizontal direction.

The rotation of the first auxiliary arm 140 may not be possible due to the sedimentation of foreign substances. When the rotation of the first auxiliary arm 140 is not possible, the movement of the link member 1600 may be limited, and thus the rotation of the spray arm 100 itself may also stop. When the first auxiliary extension part 1640 is elastically deformed by an angle of a predetermined range, a situation in which the rotation of the spray arm 100 itself is also stopped may be prevented even when the rotation of the first auxiliary arm 140 is not impossible.

The first auxiliary extension part 1640 may further include stoppers 1645*a* and 1645*b* to limit a rotational range of the first auxiliary arm 140. The stoppers 1645*a* and 1645*b* respectively, may be disposed at both sides of the first auxiliary extension part 1640.

The second auxiliary extension part 1650 may be formed in the same shape as the first auxiliary extension part 1640.

Figure 30:
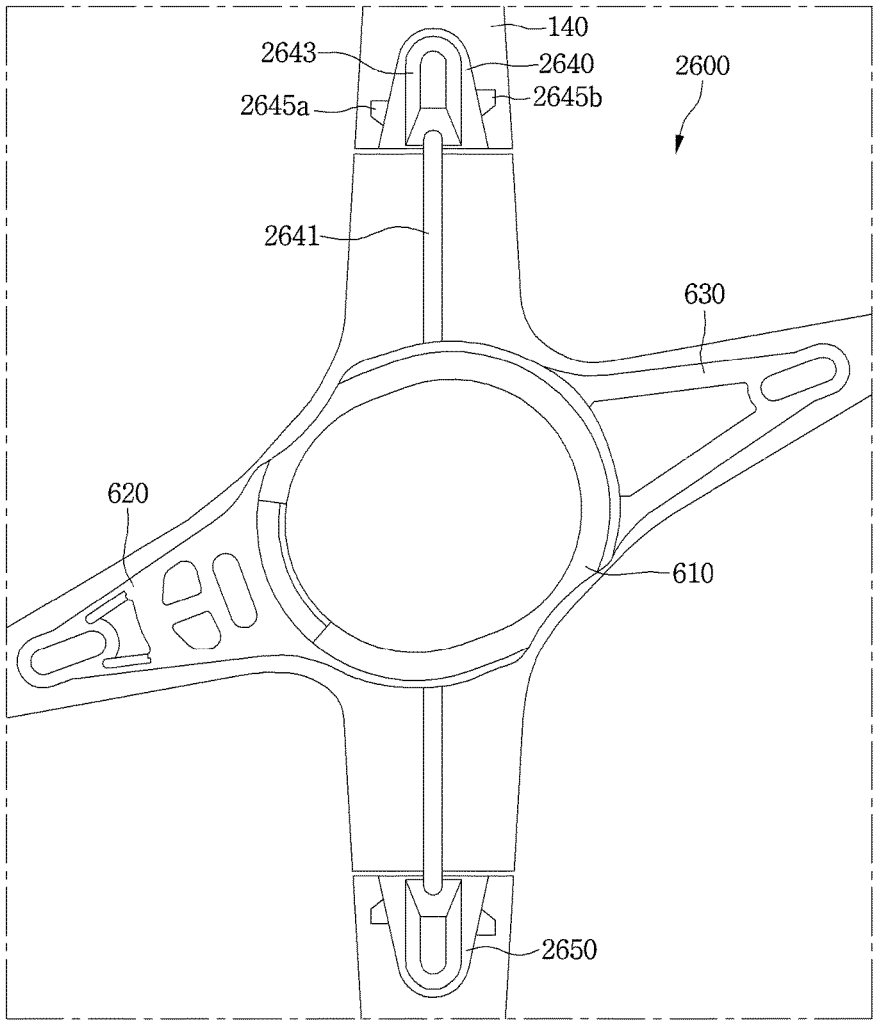
FIG. 30 is a view illustrating an example of a state in which a link member of a spray arm assembly implementation is mounted on a spray arm.

Referring to FIG. 30, the link member 2600 may include the ring-shaped rim part 610, and a plurality of extension parts 620, 630, 2640, and 2650 extending in the radial direction from the rim part 610.

The plurality of extension parts 620, 630, 2640, and 2650 may include a first auxiliary extension part 2640 and a second auxiliary extension part 2650 to rotate the auxiliary arms 140 and 150 back and forth. The first auxiliary extension part 2640 may include an elastic link 2641 extending from the rim part 610 and a power transfer unit 2643 disposed at an end portion of the elastic link 2641.

The elastic link 2641 may be formed of a material that may be elastically deformed. The coefficient of elasticity of the elastic link 2641 may be set to be deformed by a torque amount generated due to the wash water being sprayed from the first auxiliary arm 140. The elastic link 2641 may be elastically deformed within a predetermined angle range in the horizontal direction. The elastic link 2641 may be elastically deformed in a direction parallel to a reciprocating direction in which the link member 2600 moves. When the rotations of the auxiliary arms 140 and 150 are not possible, the main arm 110 may be rotatable since the rotation of the rotary gear unit 500 is possible.

The first auxiliary extension part 2640 may further include stoppers 2645*a* and 2645*b* to limit the rotational range of the first auxiliary arm 140. The stoppers 2645*a* and 2645*b* respectively, may be disposed at both sides of the power transfer unit 2643.

The stoppers 2645*a* and 2645*b* may be formed of a rib that is formed by an extension of a portion of the first auxiliary extension part 2640. When the first auxiliary arm 140 is rotated more than a predetermined range, the stoppers 2645*a* and 2645*b* come in contact with the first auxiliary arm 140 from both sides to limit the rotational range of the first auxiliary arm 140.

The second auxiliary extension part 2650 may be formed in the same shape as the first auxiliary extension part 2640.

Figure 31:
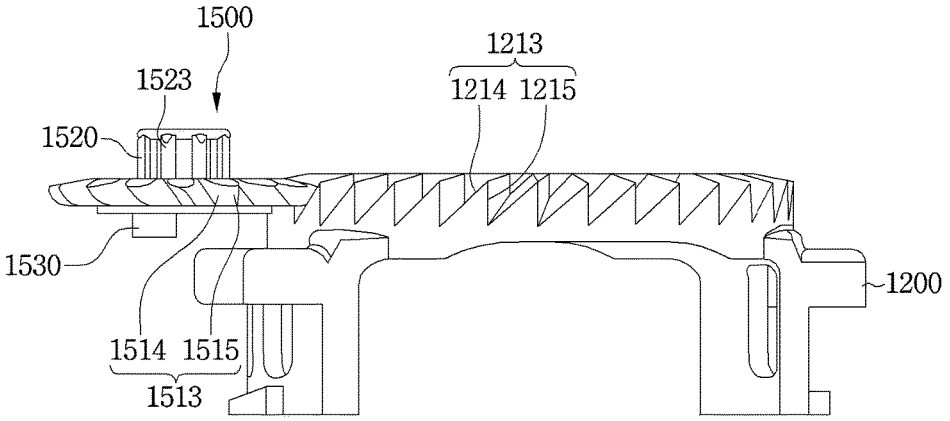
FIG. 31 is a view illustrating an example of a state in which a fixed gear unit and a rotary gear unit of a spray arm assembly implementation are engaged with each other.

Referring to FIG. 31, a fixed gear unit 1200 and a rotary gear unit 1500 may be disposed to be engaged with each other.

The rotary gear unit 1500 includes a rotation shaft accommodation unit 1520 into which the gear rotation shaft 135 disposed at the spray arm 100 is inserted, and an eccentric protrusion 1530. Unlike the above-mentioned implementations, the rotation shaft accommodation unit 1520 may protrude further upward.

The rotation shaft accommodation unit 1520 may include an elastic unit 1523. The elastic unit 1523 may be compressed more than what is illustrated. Accordingly, gear coupling between the fixed gear unit 1200 and the rotary gear unit 1500 may be released due to the fixed gear unit 1200 being spaced apart upward.

The separation of the fixed gear unit 1200 and the rotary gear unit 1500 makes it possible to enable the spray arm 100 to be rotatable even when the rotation of the rotary gear unit 1500 is not possible due to a foreign substance being caught. This is because the rotary gear unit 1500 may limit the rotation of the spray arm 100 when the fixed gear unit 1200 and the rotary gear unit 1500 are engaged while the rotation of the rotary gear unit 1500 is not possible. In this specification, a separation of engaged gears to enable the spray arm 100 to be rotatable even when driving a particular element is not possible as above is referred to as 'decoupling.'

The elastic unit 1523 may serve to press the rotary gear unit 1500 toward the fixed gear unit 1200 so that the rotary gear unit 1500 comes in close contact with the fixed gear unit 1200. Accordingly, the gear coupling between the rotary gear unit 1500 and the fixed gear unit 1200 may become more firm.

The fixed gear unit 1200 may include a plurality of gear teeth 1213 formed in asymmetrical shapes. The gear teeth 1213 may include an inclined portion 1214 and a vertical portion 1215. The rotary gear unit 1500 also includes a plurality of gear teeth 1513 formed in asymmetrical shapes. That is, the gear teeth 1513 include an inclined portion 1514 and a vertical portion 1515.

Due to the gear teeth 1213 and 1513 disposed at the fixed gear unit 1200 and the rotary gear unit 1500 formed in the asymmetrical shapes, decoupling is possible when the rotary gear unit 1500 rotates clockwise around the fixed gear unit 1200 since the inclined portions 1214 and 1514 are engaged with each other, the decoupling is not possible when the rotary gear unit 1500 rotates clockwise around the fixed gear unit 1200 since the vertical portions 1215 and 1515 are engaged with each other.

Figure 32:
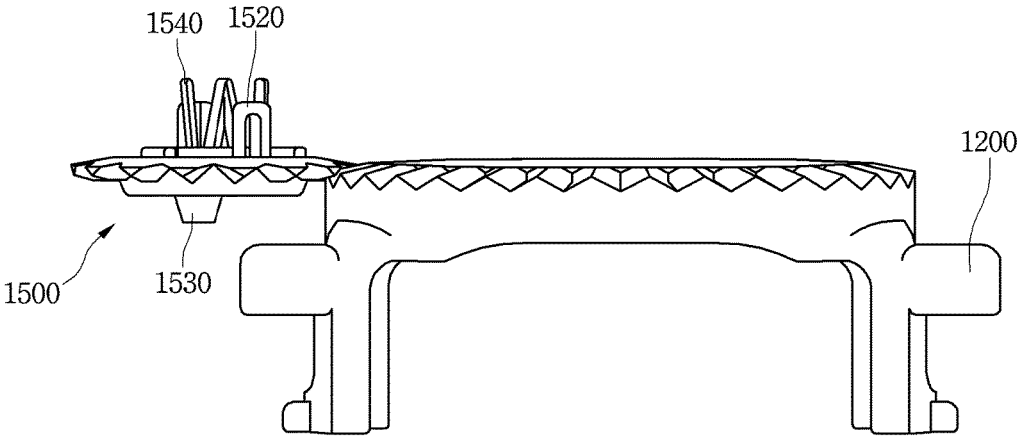
FIG. 32 is a view illustrating an example of a state in which a fixed gear unit and a rotary gear unit of a spray arm assembly implementation are engaged with each other.

Referring to FIG. 32, the fixed gear unit 1200 and the rotary gear unit 1500 may be disposed to be engaged with each other.

The rotary gear unit 1500 may include the rotation shaft accommodation unit 1520 into which the gear rotation shaft 135 disposed at the spray arm 100 is inserted, and the eccentric protrusion 1530. Unlike the above-mentioned implementations, the rotation shaft accommodation unit 1520 may protrude further upward.

In addition, the rotation shaft accommodation unit 1520 may include an elastic unit 1540.

The elastic unit 1540 may be vertically compressed. Accordingly, the rotary gear unit 1500 may vertically move. The gear coupling between the fixed gear unit 1200 and the rotary gear unit 1500 may be released due to the rotary gear unit 1500 being spaced apart at an upper side.

The separation of the fixed gear unit 1200 and the rotary gear unit 1500 makes it possible to enable the spray arm 100 to be rotatable even when the rotation of the rotary gear unit 1500 is not possible due to a foreign substance being caught.

This is because the rotation of the spray arm 100 may be limited due to the non-rotation of the rotary gear unit 1500 when the fixed gear unit 1200 and the rotary gear unit 1500 are engaged while the rotation of the rotary gear unit 1500 is not possible.

The elastic unit 1540 may serve to press the rotary gear unit 1500 toward the fixed gear unit 1200 so that the rotary gear unit 1500 comes in close contact with the fixed gear unit 1200. Accordingly, the gear coupling between the rotary gear unit 1500 and the fixed gear unit 1200 may become more firm.

Meanwhile, the elastic unit 1540 may protrude upward from an upper surface of the rotary gear unit 1500 and may be configured in a plurality. A shape of the elastic unit 1540 is not limited.

Figure 33:
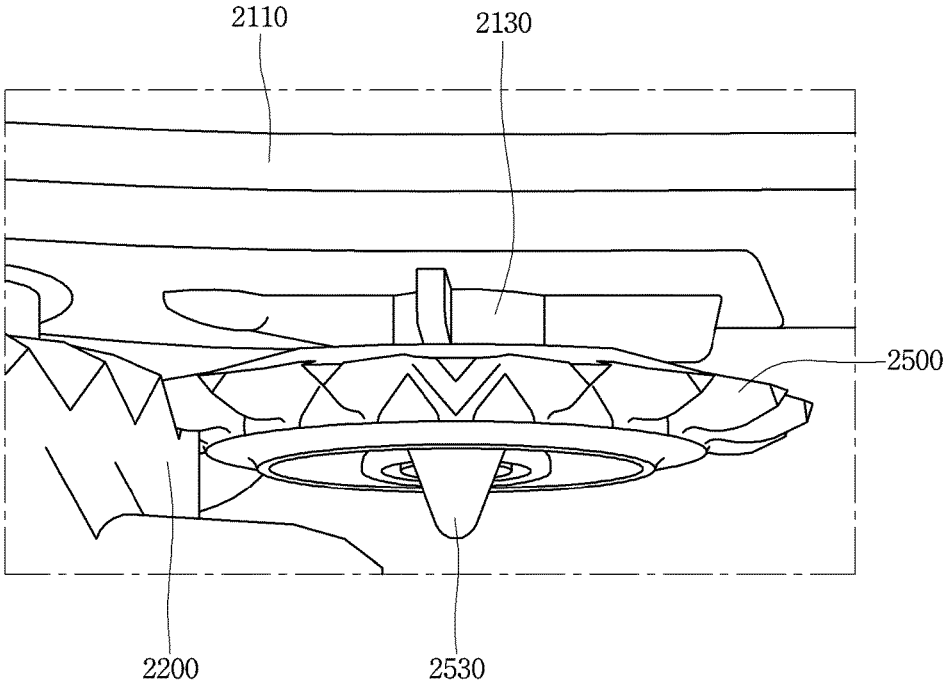
FIG. 33 is a view illustrating an example of a state in which a fixed gear unit and a rotary gear unit of a spray arm assembly implementation are engaged with each other.
Figure 34:
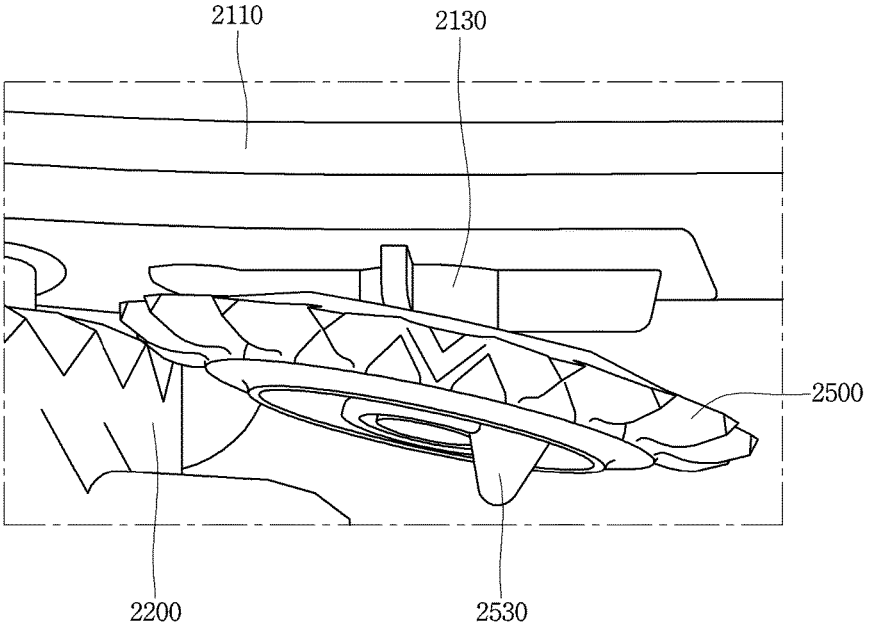
FIG. 34 is a view illustrating an example of a state in which the gear coupling between the fixed gear unit and the rotary gear unit of FIG. 33 is released.
Figure 35:
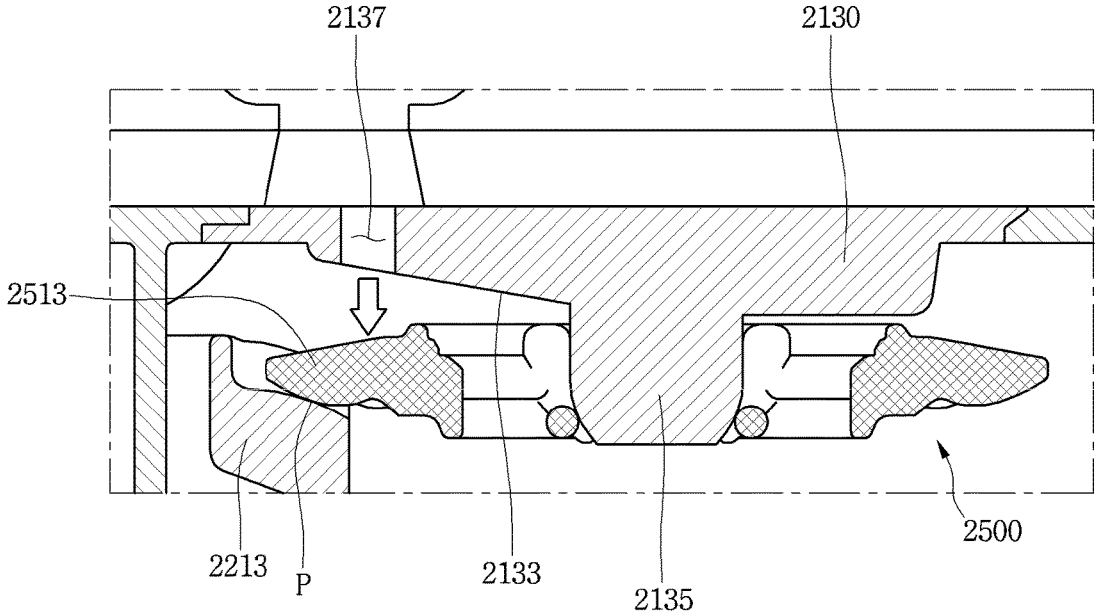
FIG. 35 is a longitudinal cross-sectional view of an example of the spray arm assembly of FIG. 33.

Referring to FIGS. 33 to 35, the spray arm assembly may include a main arm 2110, a rotary gear unit 2500 rotatably mounted on the main arm 2110, and a fixed gear unit 2200 engaged with the rotary gear unit 2500.

Gear teeth 2513 may be disposed at the rotary gear unit 2500, and gear teeth 2213 engaged with the gear teeth 2513 of the rotary gear unit 2500 may be disposed at the fixed gear unit 2200.

An eccentric protrusion 2530 inserted into the link member 600 may be disposed at the rotary gear unit 2500.

A mounting unit 2130 may be disposed at a lower portion of the main arm 2110. A gear rotation shaft 2135 into which the rotary gear unit 2500 is inserted may be disposed at a bottom surface portion 2133 of the mounting unit 2130. The gear rotation shaft 2135 may protrude downward from the bottom surface portion 2133 of the mounting unit 2130.

The bottom surface portion 2133 of the mounting unit 2130 may selectively come in contact with an upper surface portion of the rotary gear unit 2500.

The bottom surface portion 2133 of the mounting unit 2130 may be formed to become gradually higher from the gear rotation shaft 2135 toward the fixed gear unit 2200. That is, the bottom surface portion 2133 of the mounting unit 2130 may be formed of a shape gradually inclined more upward toward a center of the main arm 2110.

The rotary gear unit 2500 becomes vertically rotatable within a predetermined range by the above-mentioned shape of the bottom surface portion 2133 of the mounting unit 2130, and accordingly, the gear coupling between the rotary gear unit 2500 and the fixed gear unit 2200 may be released. That is, the decoupling may occur between the fixed gear unit 2200 and the rotary gear unit 2500.

A height of the bottom surface portion 2133 of the mounting unit 2130 may be uniform along a direction becoming farther from the fixed gear unit 2200 at the gear rotation shaft 2135.

The mounting unit 2130 may further include a spray hole 2137 through which a fluid such as the wash water is sprayed.

Some of the wash water flowing in a flow passage formed in the main arm 2110 may be discharged downward through the spray hole 2137.

The spray hole 2137 may be disposed above a place P at which the gear teeth 2213 of the fixed gear unit 2200 and the gear teeth 2513 of the rotary gear unit 2500 are engaged with each other. Accordingly, the gear teeth 2213 of the fixed gear unit 2200 may receive a downward force by the hydraulic pressure of the wash water sprayed through the spray hole 2137.

The spray hole 2137 may be disposed between the gear rotation shaft 2135 and the fixed gear unit 2200. Accordingly, a gear coupling force may be reinforced at the place P due to the gear teeth 2213 of the fixed gear unit 2200 receiving a force biased toward the fixed gear unit 2200 by the hydraulic pressure of the wash water sprayed through the spray hole 2137.

The hydraulic pressure caused by the wash water discharged through the spray hole 2137 may press the gear teeth 2513 of the rotary gear unit 2500 downward. Accordingly, the gear teeth 2513 of the rotary gear unit 2500 may come in close contact with the gear teeth 2213 of the fixed gear unit 2200.

The spray arm assembly may reinforce the gear coupling force between the rotary gear unit 2500 and the fixed gear unit 2200 using the hydraulic pressure of the wash water discharged through the spray hole 2137.

Figure 36:
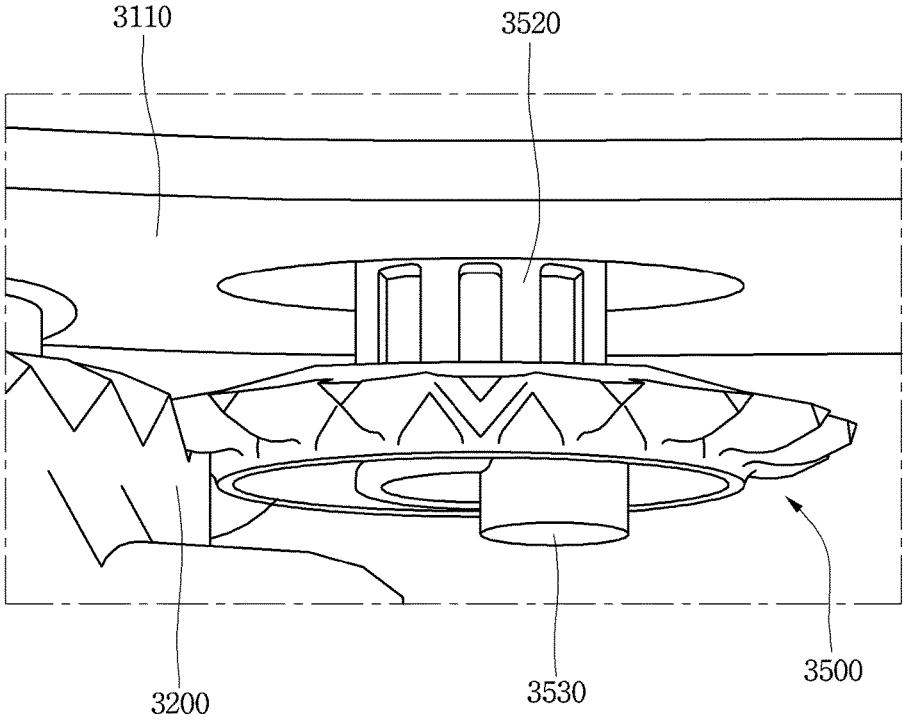
FIG. 36 is a view illustrating an example of a state in which a fixed gear unit and a rotary gear unit of a spray arm assembly implementation are engaged with each other.
Figure 37:
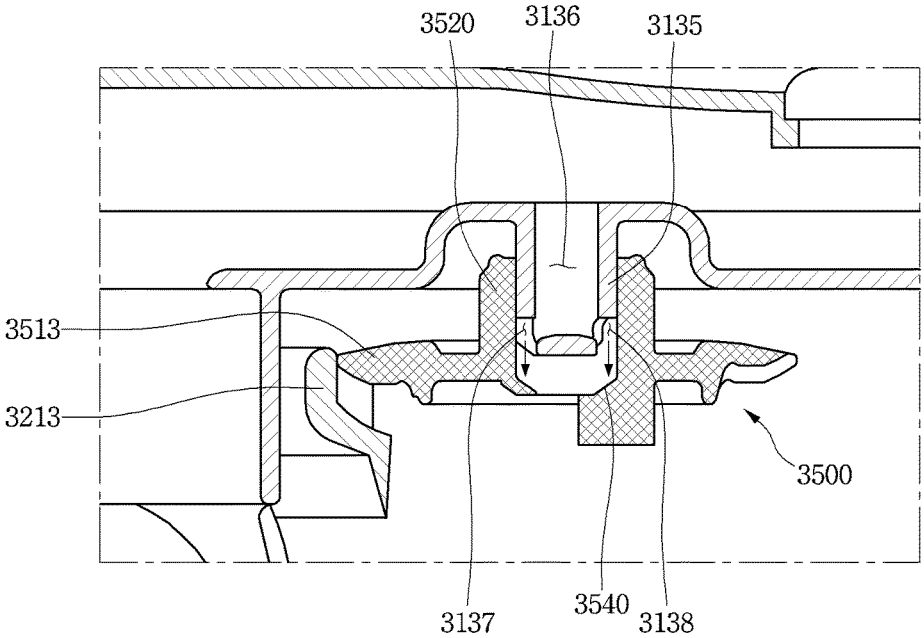
FIG. 37 is a longitudinal cross-sectional view of an example of the spray arm assembly of FIG. 36.

Referring to FIGS. 36 and 37, the spray arm assembly may include a main arm 3110, a rotary gear unit 3500 rotatably mounted on the main arm 3110, and a fixed gear unit 3200 engaged with the rotary gear unit 3500.

Gear teeth 3513 may be disposed at the rotary gear unit 3500, and gear teeth 3213 engaged with the gear teeth 3513 of the rotary gear unit 3500 are disposed at the fixed gear unit 3200.

An eccentric protrusion 3530 inserted into the link member 600 may be disposed at the rotary gear unit 3500.

A gear rotation shaft 3135 onto which the rotary gear unit 3500 is inserted may be disposed at a lower portion of the main arm 3110. The gear rotation shaft 3135 may protrude downward from a bottom surface of the main arm 3110.

The rotary gear unit 3500 may include a rotation shaft accommodation unit 3520 in which the gear rotation shaft 3135 is accommodated. The rotation shaft accommodation unit 3520 may protrude above the rotary gear unit 3500.

The gear rotation shaft 3135 may be disposed at a place where a portion of the bottom surface of the main arm 3110 is recessed by a predetermined depth. At least a portion of the rotation shaft accommodation unit 3520 may be accommodated in the recessed place.

Accordingly, the rotary gear unit 3500 may be prevented from departing from the gear rotation shaft 3135 while vertically moving.

The rotary gear unit 3500 may further include the elastic unit 1540 of FIG. 32. The elastic unit 1540 may be disposed at the rotation shaft accommodation unit 3520.

The rotary gear unit 3500 may vertically move while being inserted into the gear rotation shaft 3135. Accordingly, the gear coupling between the rotary gear unit 3500 and the fixed gear unit 3200 may be released. That is, the rotary gear unit 3500 and the fixed gear unit 3200 may be decoupled.

Spray holes 3137 and 3138 through which a fluid such as the wash water is sprayed may be formed in the gear rotation shaft 3135.

A flow passage of the main arm 3110 and a flow passage 3136 communicating with the spray holes 3137 and 3138 may be formed in the gear rotation shaft 3135. Accordingly, the wash water flowing in the main arm 3110 may be sprayed through the spray holes 3137 and 3138 via the flow passage 3136 of the gear rotation shaft 3135.

Some of the wash water flowing in the flow passage formed at the main arm 3110 may be discharged downward through the spray holes 3137 and 3138.

The spray holes 3137 and 3138 may be formed in a lower portion of the gear rotation shaft 3135 to be disposed at an inner side 3540 of the rotary gear unit 3500.

The hydraulic pressure caused by the wash water discharged through the spray holes 3137 and 3138 may press the inner side 3540 of the rotary gear unit 3500 downward.

The wash water sprayed to the inner side 3540 of the rotary gear unit 3500 may be discharged through an outlet formed at the rotary gear unit 3500.

Accordingly, the rotary gear unit 3500 may be closely attached in a downward direction, and the gear teeth 3513 of the rotary gear unit 3500 may come in close contact with the gear teeth 3213 of the fixed gear unit 3200.

That is, the spray arm assembly may reinforce the gear coupling force between the rotary gear unit 3500 and the fixed gear unit 3200 using the hydraulic pressure of the wash water discharged through the spray holes 3137 and 3138.

The spray holes 3137 and 3138 may be disposed in a plurality. Specifically, the spray holes 3137 and 3138 may include a first spray hole 3137 and a second spray hole 3138.

The first spray hole 3137 may be formed at a position near the gear teeth 3213 of the fixed gear unit 3200, and the second spray hole 3138 may be disposed at a position distant from the gear teeth 3213 of the fixed gear unit 3200.

In the dishwasher 1, the non-rotation of the spray arm 100 may be prevented by the decoupling between the rotary gear unit and the fixed gear unit when the rotation of the rotary gear unit is not possible, thereby preventing a decline in washing efficiency.

Simultaneously, the gear coupling force between the rotary gear unit and the fixed gear unit is reinforced using the hydraulic pressure of the wash water sprayed through the spray hole, thereby preventing the gear coupling force between the rotary gear unit and the fixed gear unit from decreasing due to a structure for decoupling.

In this way, a spray angle in the dishwasher 1 may be varied due to the auxiliary arms 140 and 150 rotatably mounted on the main arm 110 and separately rotating from the rotation of the main arm 110. Accordingly, the washing efficiency of the dishwasher 1 increases.

In addition, the spray arm 100 may be rotated by the repulsive force generated due to the wash water being sprayed through the spray hole, thereby not requiring a separate driving source.

In addition, the rotary force of the spray arm 100 may be converted to a force for rotating the auxiliary arms 140 and 150 back and forth by the interaction between the fixed gear unit 200, the rotary gear unit 500, and the link member 600. Consequently, there is an advantage of not requiring a separate driving source for rotating the auxiliary arms 140 and 150.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a tub with a space configured to accommodate objects to be washed;

a spray arm comprising:

a pair of first and second arms provided in the tub, configured to extend in a first direction, and configured to spray wash water to the objects, and a pair of auxiliary arms configured to spray the wash water to the objects while rotating about a rotation axis defined by a direction in which the auxiliary arms extend, the pair of auxiliary arms being configured to extend in a second direction while being spaced apart from the first and second arms by a predetermined angle, the second direction being perpendicular of the first direction;

an arm holder detachably inserted into the tub, the arm holder being configured to define a channel through which the wash water flows to the spray arm, wherein the arm holder is configured to support the spray arm to be rotated to spray the wash water from the first and second arms and the auxiliary arms; and a flow passage switching unit provided inside the arm holder and configured to move vertically to selectively supply the wash water to the first and second arms or the auxiliary arms a power transfer assembly configured to convert a rotary force of the spray arm into a linear reciprocating movement to reciprocally rotate the auxiliary arms, wherein the power transfer assembly comprises:

a fixed gear unit fixed to a lower part of the tub, the fixed gear unit including gear teeth provided at an outer circumferential surface of the fixed gear unit;

a rotary gear unit rotatably mounted to the spray arm and configured to engage with the gear teeth of the fixed gear unit, the rotary gear unit including an eccentric protrusion that is eccentric from a center of rotation of the rotary gear unit; and a link member coupled to the eccentric protrusion and configured to reciprocally rotate the auxiliary arms.

2. The dishwasher according to claim 1, further comprising:

a sump that is mounted at a bottom surface of the tub and that is configured to store the wash water; and a water supply pump configured to intermittently supply the wash water from the sump to the arm holder, wherein the flow passage switching unit is configured to switch a wash water flow passage to the first and second arms or the auxiliary arms.

3. The dishwasher according to claim 1, wherein the first and second arms include first and second extension parts, to which the auxiliary arms are rotatably coupled, and the first and second extension parts are provided with auxiliary arm connection members to rotatably support the auxiliary arms.

4. The dishwasher according to claim 3, wherein the first and second arms have first and second main flow passages, the first and second extension parts have first and second transfer flow passages, and the flow passage switching unit is configured to selectively open and close the first and second main flow passages or the first and second transfer flow passages.

5. The dishwasher according to claim 1, wherein the arm holder comprises:

an inlet port that is inserted and located in the lower part of the tub and that is configured to allow the wash water to be introduced through the inlet port; and an arm holder chamber coupled to a lower part of the spray arm, the arm holder chamber defining a channel through which the wash water flows to the spray arm, and wherein the flow passage switching unit is located in the arm holder chamber, the flow passage switching unit being configured to move upward and downward in the arm holder chamber to switch a wash water flow passage.

6. The dishwasher according to claim 1, wherein the spray arm is rotated by a repulsive force generated by the wash water sprayed through spray holes located in the first and second arms or the auxiliary arms.

7. The dishwasher according to claim 6, wherein the spray holes are located in the first and second arms and the auxiliary arms with spray holes located in the auxiliary arms having a different spray direction than spray holes located in the main arms.

8. The dishwasher according to claim 1, wherein the first and second arms are provided with a plurality of spray holes oriented in a direction opposite of a direction in which the spray arm is rotated, and a spray pressure of the wash water sprayed through the spray holes is greater than a rotational resistance of the arm holder.

9. The dishwasher according to claim 1, wherein the auxiliary arms are provided with a plurality of spray holes oriented in a direction opposite of a first direction in which the spray arm is rotated or in a direction opposite of a second direction in which the spray arm is rotated, and a spray pressure of the wash water sprayed through the spray holes is greater than a rotational resistance of the arm holder.

10. The dishwasher according to claim 1, wherein the fixed gear unit includes a rim part, into which the arm holder is inserted and held, and the rim part is configured to prevent departure of the arm holder based on wash water being supplied to the arm holder.

11. The dishwasher according to claim 1, wherein the rotary gear unit comprises:

a rim part located at an outer circumferential surface of the rotary gear unit, the rim part including gear teeth which are engaged with the fixed gear unit; and a rotation shaft accommodating unit located in a center of the rim part, and wherein the eccentric protrusion is spaced apart from a center of rotation of the rotation shaft accommodating unit.

12. The dishwasher according to claim 1, wherein the link member comprises:

a rim part including a rectangular insertion hole located in a center of the rim part into which the arm holder is inserted;

a pair of main extension parts configured to extend from an outer circumferential surface of the rim part in the direction in which the main arms extend; and a pair of auxiliary extension parts configured to extend from the outer circumferential surface of the rim part in the direction in which the auxiliary arms extend.

13. The dishwasher according to claim 12, wherein the main extension parts are fastened to lower parts of the first and second arms and are configured to be moved in a direction parallel to a direction in which the auxiliary arms are rotated, and wherein the auxiliary extension parts are fastened to the auxiliary arms and are configured to reciprocally rotate the auxiliary arms.

14. The dishwasher according to claim 12, wherein one of the main extension parts is provided with a recessed part which is configured to accommodate the rotary gear unit, and wherein the recessed part is provided with an insertion part, into which the eccentric protrusion is inserted.

* * * * *